US006244733B1

(12) United States Patent
Fong et al.

(10) Patent No.: US 6,244,733 B1
(45) Date of Patent: Jun. 12, 2001

(54) LOW VOLTAGE TRACK LIGHTING SYSTEM

(75) Inventors: Franklin Fong, Wheeling; John J. O'Rourke, Downers Grove; Scott Roos, Glenview; Peter F. Wachter, Northfield, all of IL (US)

(73) Assignee: Juno Manufacturing, Inc., Des Plaines, IL (US)

( * ) Notice: Subject to any disclaimer, the term of this patent is extended or adjusted under 35 U.S.C. 154(b) by 0 days.

(21) Appl. No.: 09/513,359

(22) Filed: Feb. 25, 2000

(51) Int. Cl.[7] ..... F21V 21/35

(52) U.S. Cl. ..... 362/391; 362/147; 362/404

(58) Field of Search ..... 362/147, 226, 362/238, 239, 249, 250, 391, 373, 404, 294, 269, 407, 427; 439/110, 111, 112, 116, 117, 119

(56) References Cited

U.S. PATENT DOCUMENTS

| | | | | |
|---|---|---|---|---|
| 3,037,110 | * | 5/1962 | Williams | 362/404 |
| 4,861,273 | | 8/1989 | Wenman et al. . | |
| 4,979,081 | | 12/1990 | Leach et al. . | |
| 5,151,037 | | 9/1992 | Range et al. . | |
| 5,151,038 | | 9/1992 | Range et al. . | |
| 5,154,509 | * | 10/1992 | Wulfman et al. | 362/226 |
| 5,340,322 | | 8/1994 | Poulsen . | |
| 5,455,754 | | 10/1995 | Hoffner . | |
| 5,833,358 | | 11/1998 | Patik . | |
| 6,022,129 | * | 2/2000 | Tang | 362/404 |

* cited by examiner

*Primary Examiner*—Y. Quach
(74) *Attorney, Agent, or Firm*—Anthony S. Zummer

(57) ABSTRACT

The present invention is an improved low voltage track lighting system. The system includes a flat track which may be bent. The track has a flat insulator base with opposed flat sides. The depth of the base is greater than its thickness. A thin flat electrical conductor is fixed to each of the flat sides of the base forming conductors on opposite sides of the base. A step down transformer is adapted to be connected to a source of electric power. A feed mount is adapted to be fixed to a supporting surface to be held by the supporting surface. An electric conductive path in the feed mount is connected to each conductor and to the step down transformer, so that each of the conductors is connected to the step down transformer. An adapter is supported on the track and is in electric contact with each of the conductors of the track. A low voltage lamp is supported on the adapter and in electric contact with the adapter to be energized by an electric current from the step down transformer.

23 Claims, 16 Drawing Sheets

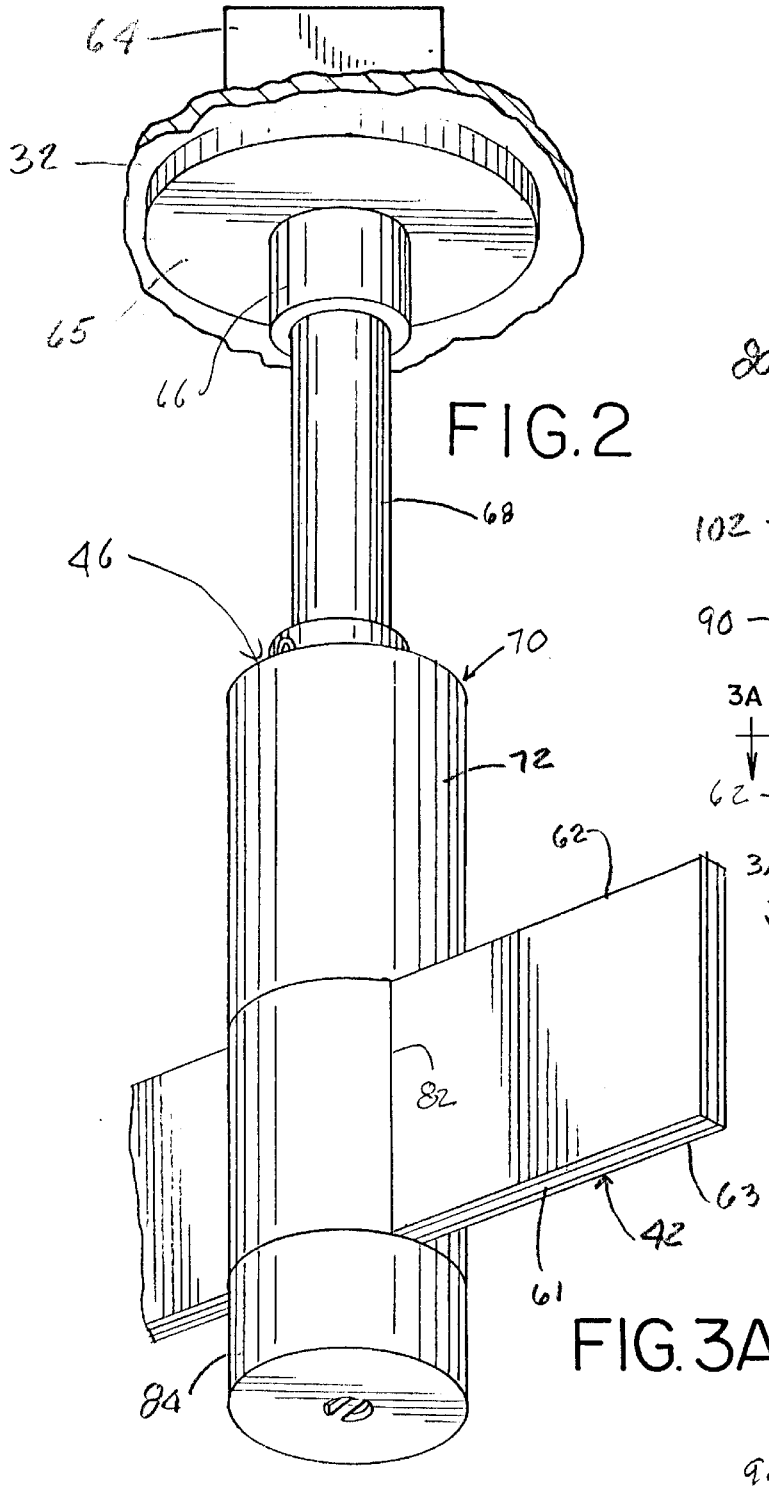
FIG. 2
FIG. 3
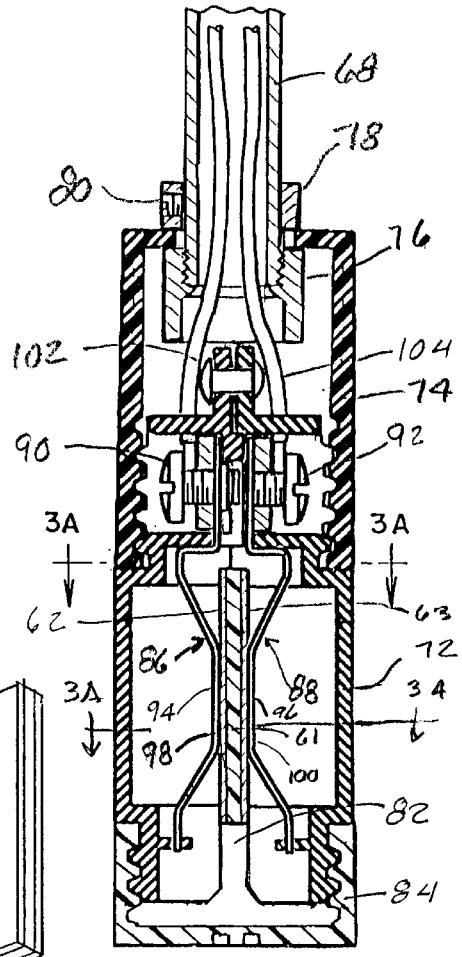
FIG. 3A
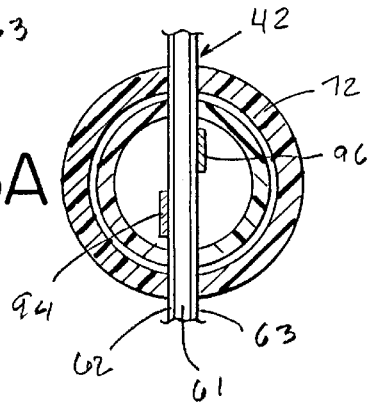

78
80
74
76
90
92
72
86
88
98
100
94
96
84

155
140
142
137
138
148
150
154
154

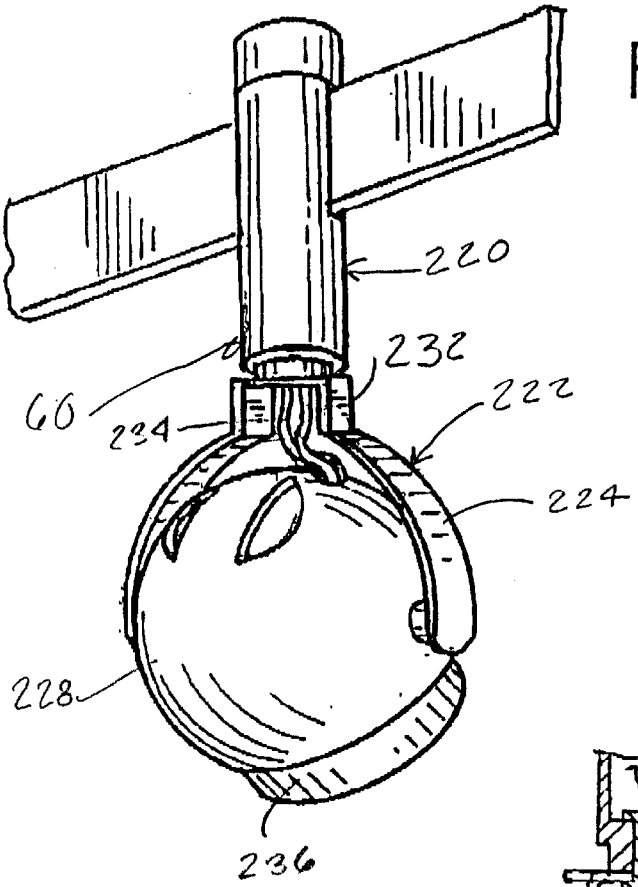
FIG. 21
FIG. 22
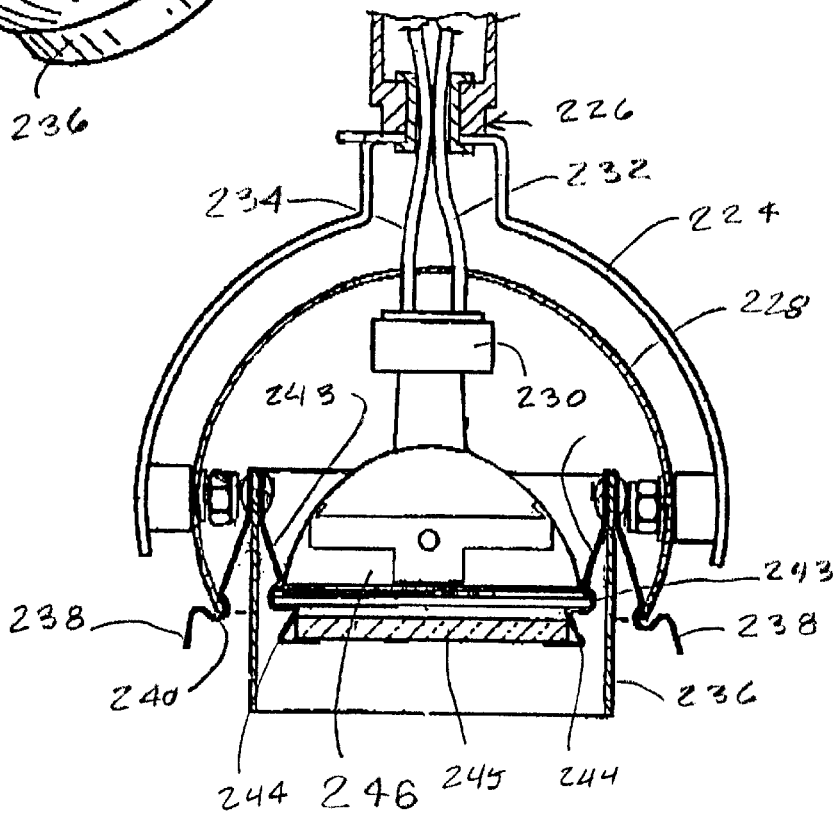

LOW VOLTAGE TRACK LIGHTING SYSTEM

BACKGROUND OF THE INVENTION

Track lighting is accepted both in commercial and residential applications. The advantages of track lighting are well recognized, in that, lights may be placed and the position of the lights may be changed to accommodate changes in display of merchandise in commercial applications and rearrangement of furniture in residential applications. Heretofore, track lighting has been generally arranged in straight lines. In certain applications, it is desirable to be able to provide a bend or a curve in the track to accommodate a particular structure, such as, a corner so that it is desirable to bend a track around a corner, or to bend or curve track to reflect or mimic the arcuate nature of an architectural environment, such as, columns, arcuate walls and the like, or a lighting arrangement having several curves in the track may be found desirable.

Track lighting often uses low voltage lamps, such as, 12-volt or 24-volt lamps. Customarily, the track carries a 110-volt current. When it is desirable to have a low voltage lamp, a lamp with a step down transformer is mounted on the track. The utilization of the step down transformer for each lamp makes the track lighting installation expensive. The track with many transformers is heavy in the event that there is a number of low voltage lamps on a given track.

It is desirable to provide a track which may be formed to accommodate a particular configuration and to carry a low voltage, so that low voltage lamps may be mounted on the track without a separate step down transformer in association with each lamp.

BRIEF SUMMARY OF THE INVENTION

The present invention is a low voltage track lighting system. The system includes a bendable essentially flat track which may be formed to a desired configuration. The flat track includes a flat insulator base having a pair of opposed flat sides so that the base has a depth greater than its thickness. A thin flat electrical conductor is fixed to each of the flat sides so that there are electrical conductors on opposite sides of the track. A step down transformer adapted to be connected to a conventional source of electric power is connected to the track. A mount is connected to the track to support the track. The mount is adapted to be fixed to a supporting surface to be held thereby. An electric conductive path inside the mount is connected to each thin flat electrical conductor and to the step down transformer. An adapter is supported on the track and is in electric contact with each of the conductors of the track. A low voltage lamp is supported on the adapter and is in electric contact with the adapter to be energized by a current from the step down transformer.

BRIEF DESCRIPTION OF THE SEVERAL VIEWS OF THE DRAWINGS

FIG. 2 is an enlarged perspective view of a ceiling feed mount which is part of the subject system;

FIG. 3 is a cross sectional view through the mount of FIG. 2;

FIG. 3A is a cross sectional view taken on line 3A—3A of FIG. 3;

DETAILED DESCRIPTION OF THE INVENTION

Figure 1:
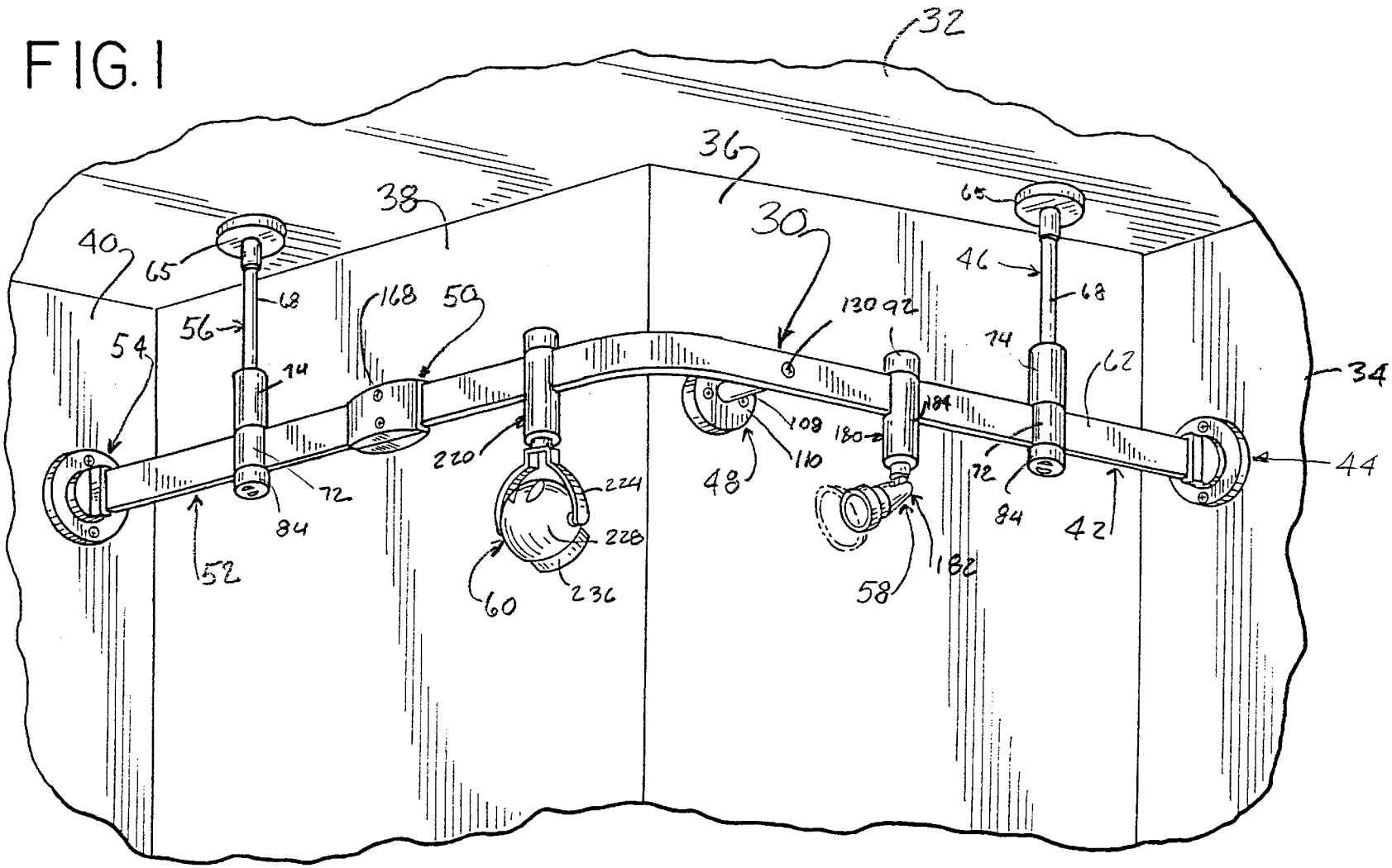
FIG. 1 is a perspective view of a low voltage track lighting system embodying the present invention.

Referring now the drawings, and especially to FIG. 1, a low voltage track lighting system embodying the present invention is shown therein, and the system is generally indicated by numeral 30. As may be seen in FIG. 1, the track lighting system 30 is mounted in a structure having a conventional ceiling 32, a first wall 34, a second wall 36, a third wall 38, and a fourth wall 40. Walls 36 and 38 are perpendicular to each other to define an outside corner. The track lighting system is supported in the structure on the ceiling and three of the walls. The track lighting system includes a first track 42 having an end mounted in a wall feed mount 44 secured to the wall 34. Track 42 is also supported by a ceiling feed mount 46 which is secured to ceiling 32. An outrigger feed mount 48 is secured to wall 36 and also supports track 42. The track is bent around the outside corner formed by walls 36 and 38 and has one end mounted in a link 50. A second track 52 has one end mounted in link 50 and the other mounted in a wall feed mount 54, which is identical in construction to wall feed mount 44. A ceiling feed mount 56, identical in construction to ceiling feed mount 46, is fixed to ceiling 32 and supports track 52. A lamp assembly 58 is mounted on track 42 and supported thereby. A second lamp assembly 60 is mounted on track 42 and is supported by the track. The tracks may be supported solely by the ceiling mounts or by the outrigger mounts or by the feed mounts 44 and 54. The track may be bent, as is desired, to go around outside corners or into corners, or formed into any particular desired shape, whether it be a simple curve, or a serpentine configuration for a particular usage. While FIG. 1 shows typical installation configurations of the system, the flexible modular nature of the system allows many other configurations. For example, the outrigger mounting could be mounted to the ceiling or a floor.

Both tracks 42 and 52 are identical in their construction. As may be seen in FIGS. 2 and 3, track 42 includes an insulating material base 61, which may be formed by bending. The insulating material, in the present instance, is a low-density polyethylene. Polyethylene base 61 has a thickness of 0.118 inches and a depth of 1⅜ inch, so that the track may be bent with its depth perpendicular to the ceiling. Insulator plastic base or core 61 has two flat parallel sides. Identical aluminum conductors 62 and 63, each having a thickness of 0.020 inches are secured to each side of the track so that the track has a conductor on opposite sides of the base. The plastic core 61 with the aluminum conductors 62 and 63 may be formed into a curve as needed. Although a specific size has been identified herein, it is readily apparent that the depth and thickness of the base or thickness and material of the conductor may be adjusted to accommodate a particular application.

Track 42 is connected to a source of electric power through a step down transformer 64 and ceiling feed mount 46. The transformer is mounted on top of ceiling 32. Step down transformer 64 is conventional in its construction and well known in the art, and is connected to a conventional source of 110-volt electric power (which is not shown herein). The step down transformer in this instance steps down the voltage to 12-volts, though other voltages may be used.

Figure 4:
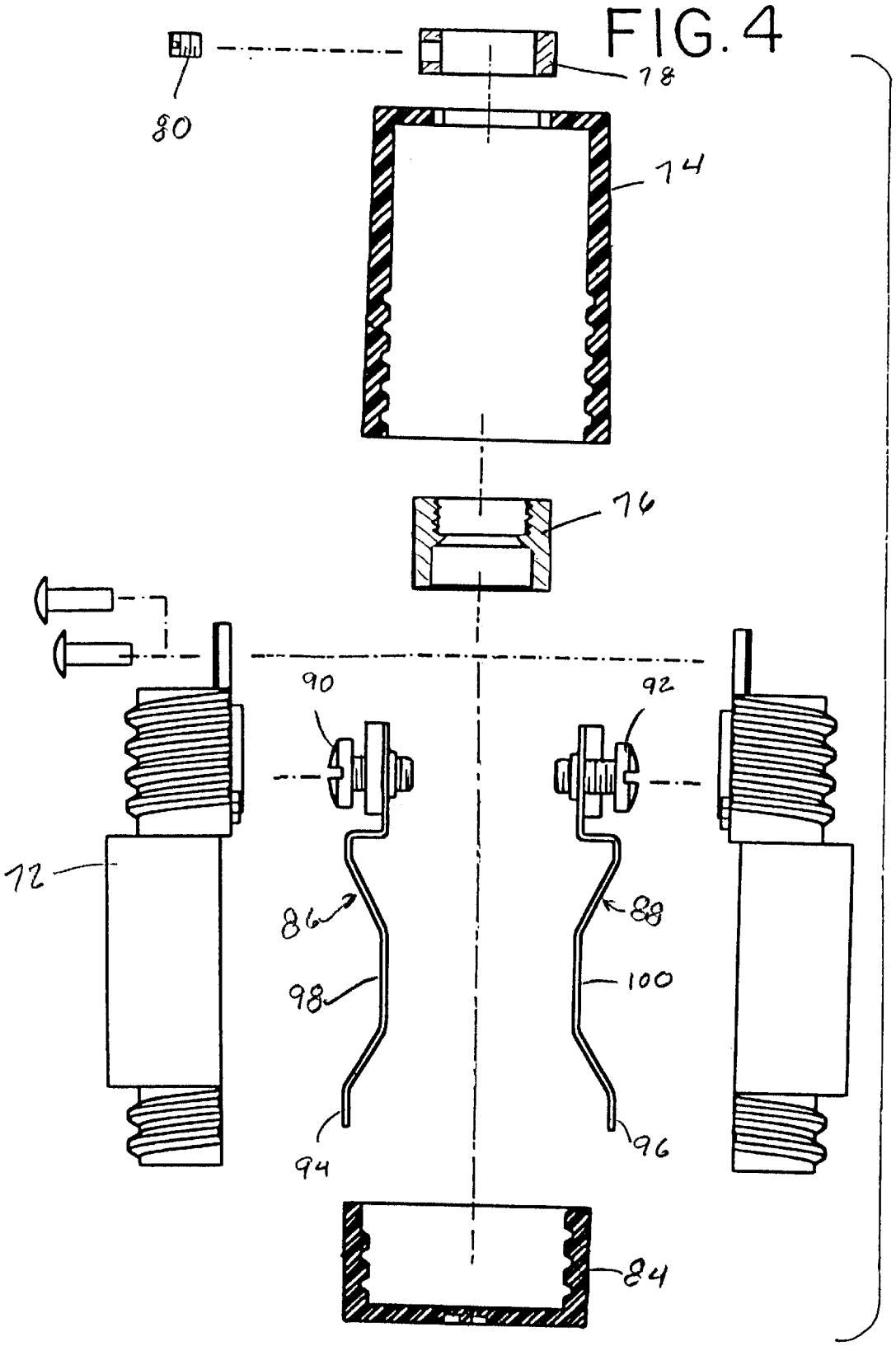
FIG. 4 is an exploded view of the mount of FIGS. 2 and 3.

The construction of ceiling feed mount 46 is best seen in FIGS. 2, 3, and 4. Feed mount 46 includes a ceiling disk 65 which is fixed to ceiling 32. The ceiling disk includes a nozzle 66. A support conduit 68 is fixed in nozzle 66 at one end and the other end is fixed in an electric feed cylinder assembly 70. Electric feed cylinder assembly includes a split housing 72 which is threadedly mounted in a connector cap 74. Support conduit 68 is mounted in cap 74 and threadedly engages an internal lock 76 positioned inside cap 74. A lock ring 78 is mounted on conduit 68 on the outside of cap 74 and held thereon by set screw 80. Split housing 72 includes a slot 82 which extends through the housing and opens into the lower end of the housing, as viewed in FIG. 3. A lock cap 84 is threadedly mounted on the end of housing 72 to close the end of slot 82. A pair of contact assemblies 86 and 88 is mounted in the housing. Each of the contact assemblies 86 and 88 has respective connector screws 90 and 92. The connector screws 90 and 92 are connected to identical resilient contacts 94 and 96, respectively. The contacts 94 and 96 have flat portions or pads 98 and 100 for engagement with the track. The contacts 94 and 96 are connected to step down transformer 64 through wires 102 and 104, respectively, to provide an electric conductive path through feed mount 46. The current from the step down transformer 64 is carried to the contact assemblies 86 and 88, so that the contacts have a 12-volt potential, To though other voltages may be used. The contacts are offset relative to each other, as seen in FIG. 3A, so that the contacts do not contact each other when there is no track in the slot.

Track 42 is positioned in slot 82 for mounting of the track in feed mount 46. Contacts 94 and 96 have their respective flat portions 98 and 100 in contact with respective conductors of the track. The resilience of the contacts holds the flat portions in secure electrical connection with the respective conductors. Once the track is in position in the slot, lock cap 84 is mounted onto the housing to lock the track into the housing and therefore be supported by the ceiling feed mount. The ceiling feed mount simultaneously provides the mechanical support for the track, as well as, provides a source of electric power to the track.

Figure 5:
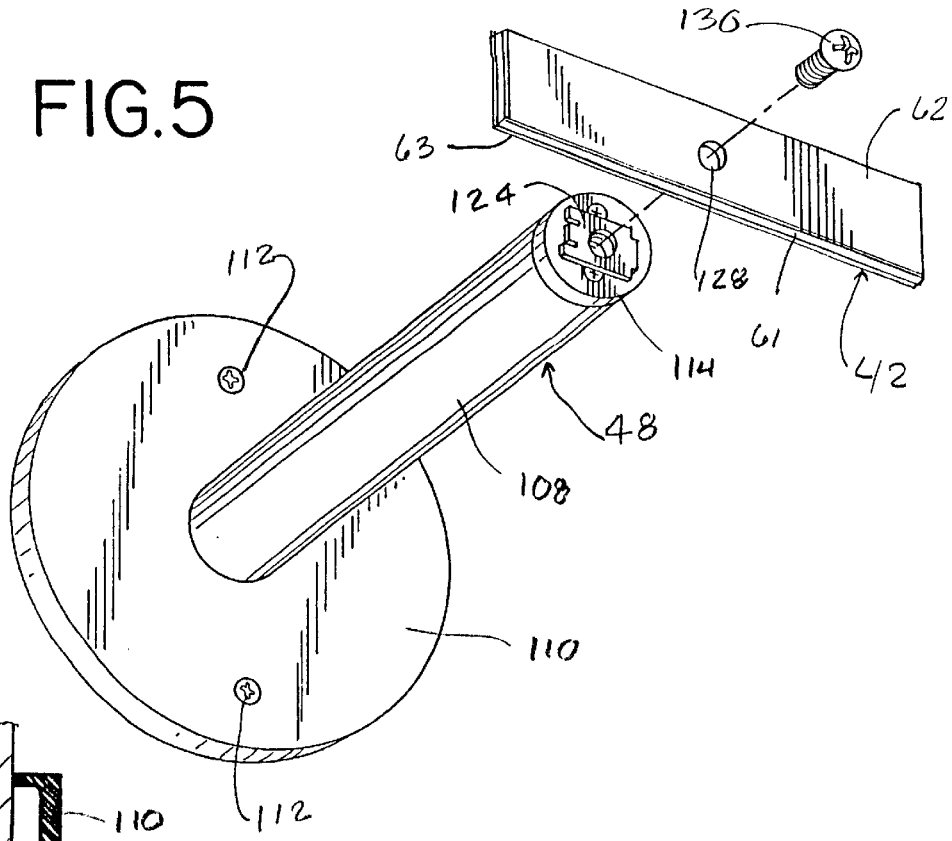
FIG. 5 is a perspective view of an outrigger feed mount shown in FIG. 1.
Figure 6:
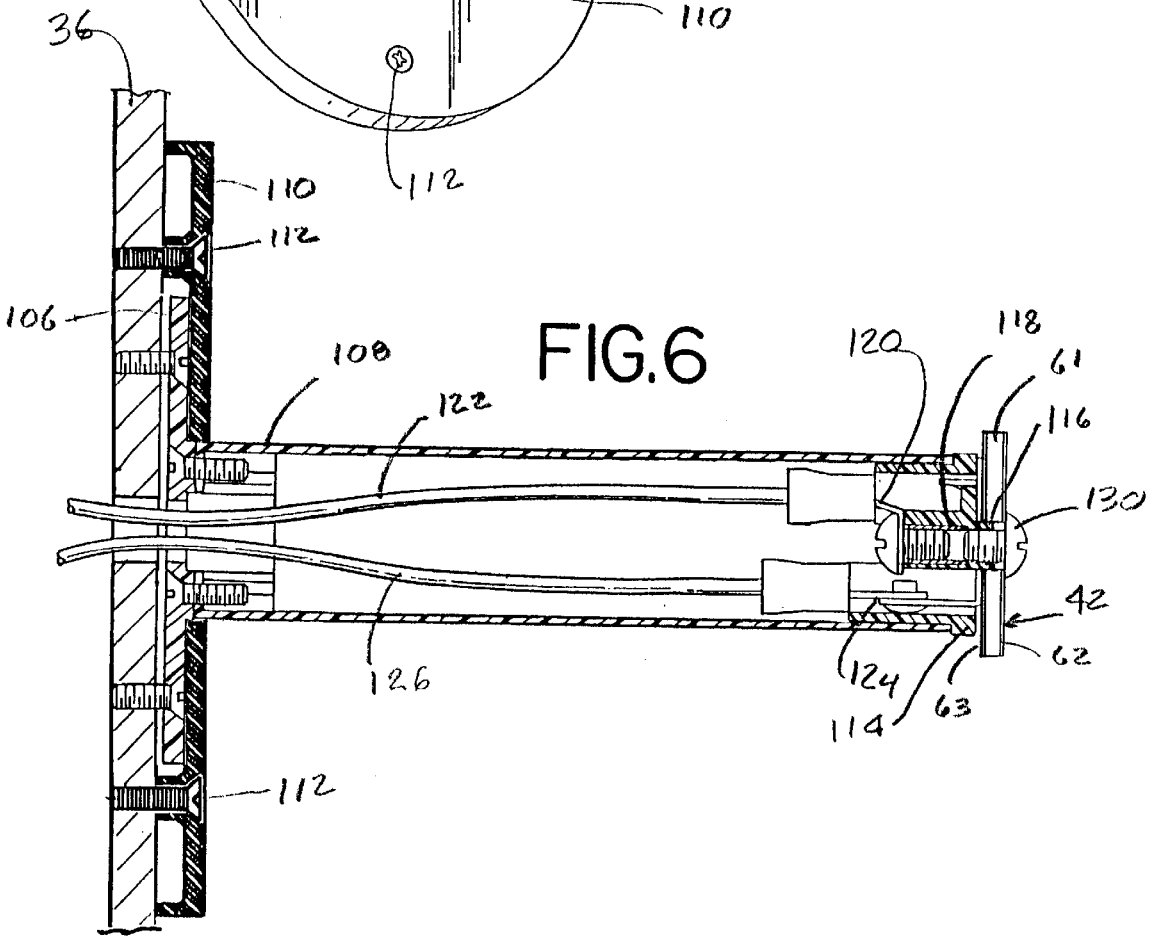
FIG. 6 is a cross sectional view taken through the outrigger mount of FIG. 5.
Figure 7:
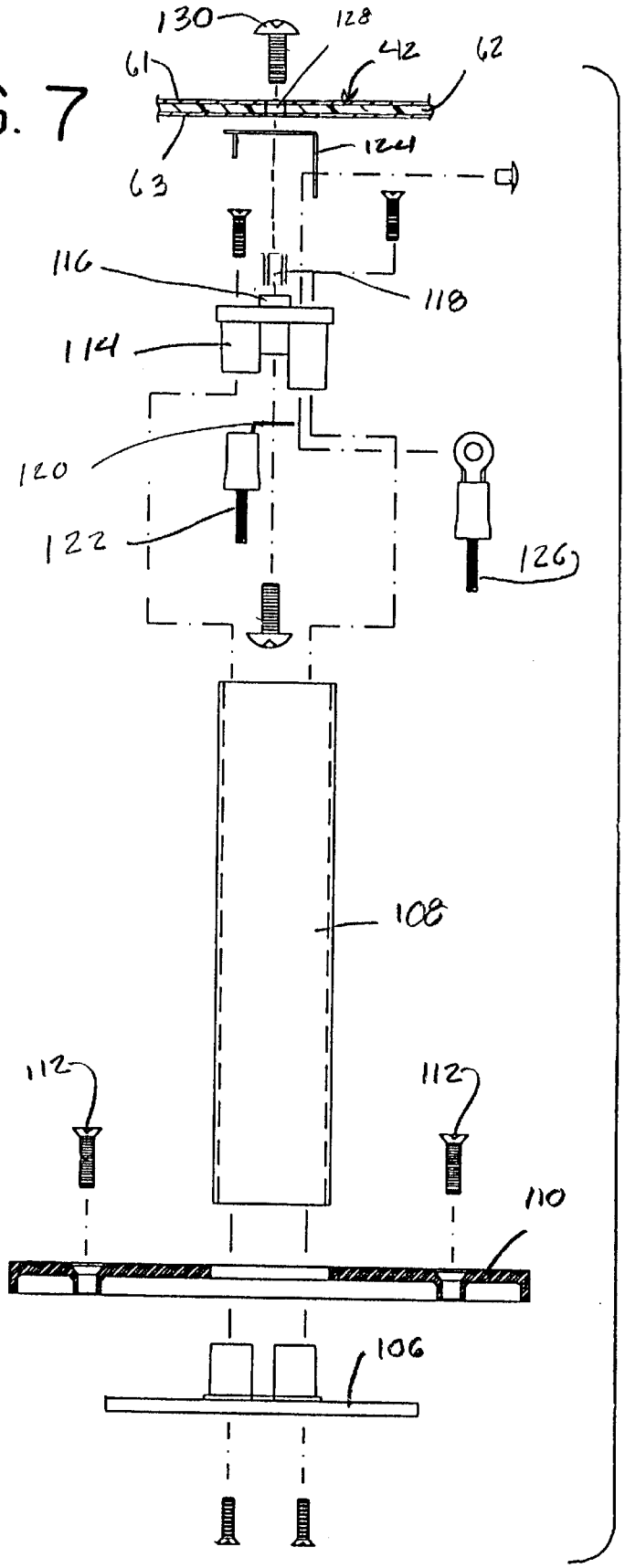
FIG. 7 is an exploded view of the outrigger mount of FIGS. 5 and 6.

The construction of outrigger feed mount 48 is best seen in FIGS. 5, 6, and 7. The outrigger mount has one end adapted to be secured to and supported by supporting surface wall 36. Mount 48 includes an outrigger having a mounting disk 106 which has an outrigger tube 108 mounted thereon. A disk is held onto wall 36 by a canopy 110, which has screws 112 secured in the wall. A cover plug 114 is mounted in the end of the tube opposite to the end secured to the wall. The cover plug includes an insulator post 116. A tubular electric conductor sleeve 118 is mounted in plug 114. The tubular sleeve is connected to an electric conductive path which has a wire terminal 120 connected to a wire 122. An internal contact 124 is mounted on plug 114 and is connected to a wire 126. The wires 122 and 126 are connected to a step down transformer, not shown herein, which is connected to a conventional source of 110-volt electric power, which is not shown.

Track 42 has a mounting aperture 128 therein which receives insulator post 116. A conductive screw 130 is mounted in post 116 in contact with tubular sleeve 118. Thus, the track has its interior conductor 63 in electric contact with contact 124, and exterior conductor 62 in contact with conductor screw 130. The screw provides a dual function of holding the track onto the post and providing electrical connection with wire 122 through sleeve 118. Wires 122 and 126 are connected to the step down transformer.

There are instances when the track requires mechanical support, but no additional connection to a source of electric current. A support outrigger mount 131 shown in FIGS. 8, 9, and 10 may be used. Mount 131 is similar in construction to outrigger mount 48 where the same numbers are used to identify like parts. Mount 131 does not have an electric conductive path so that there are no wires. Mount 131 has the mounting disk 106 with the outrigger tube 108 mounted thereon. Disk 106 is secured to wall 36 by screws 132 mounted in toggle nuts 133. Track 42 is secured to post 116 positioned in aperture 128 by screw 130.

Figure 11:
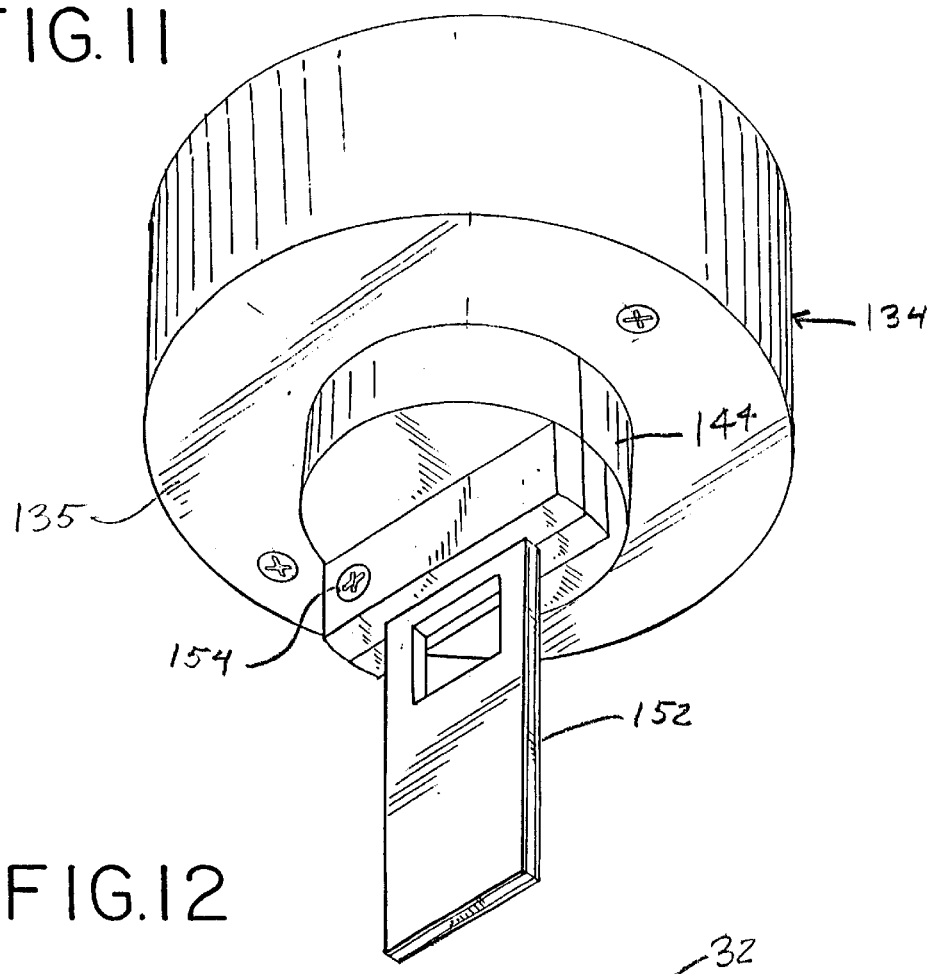
FIG. 11 is a perspective view of a ceiling feed mount.
Figure 12:
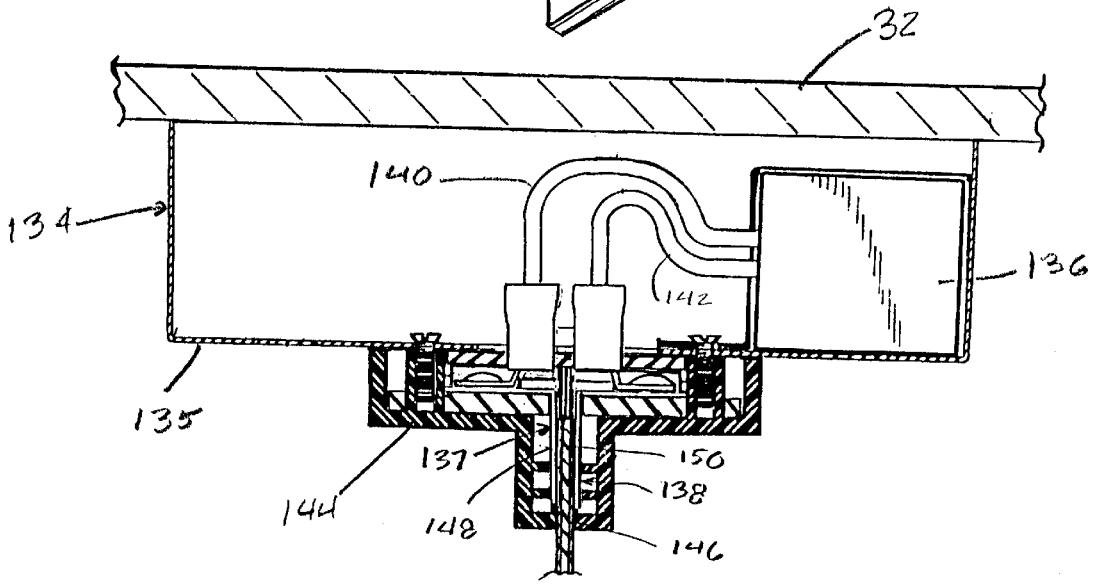
FIG. 12 is a cross sectional view of the ceiling feed mount of FIG. 11.
Figure 13:
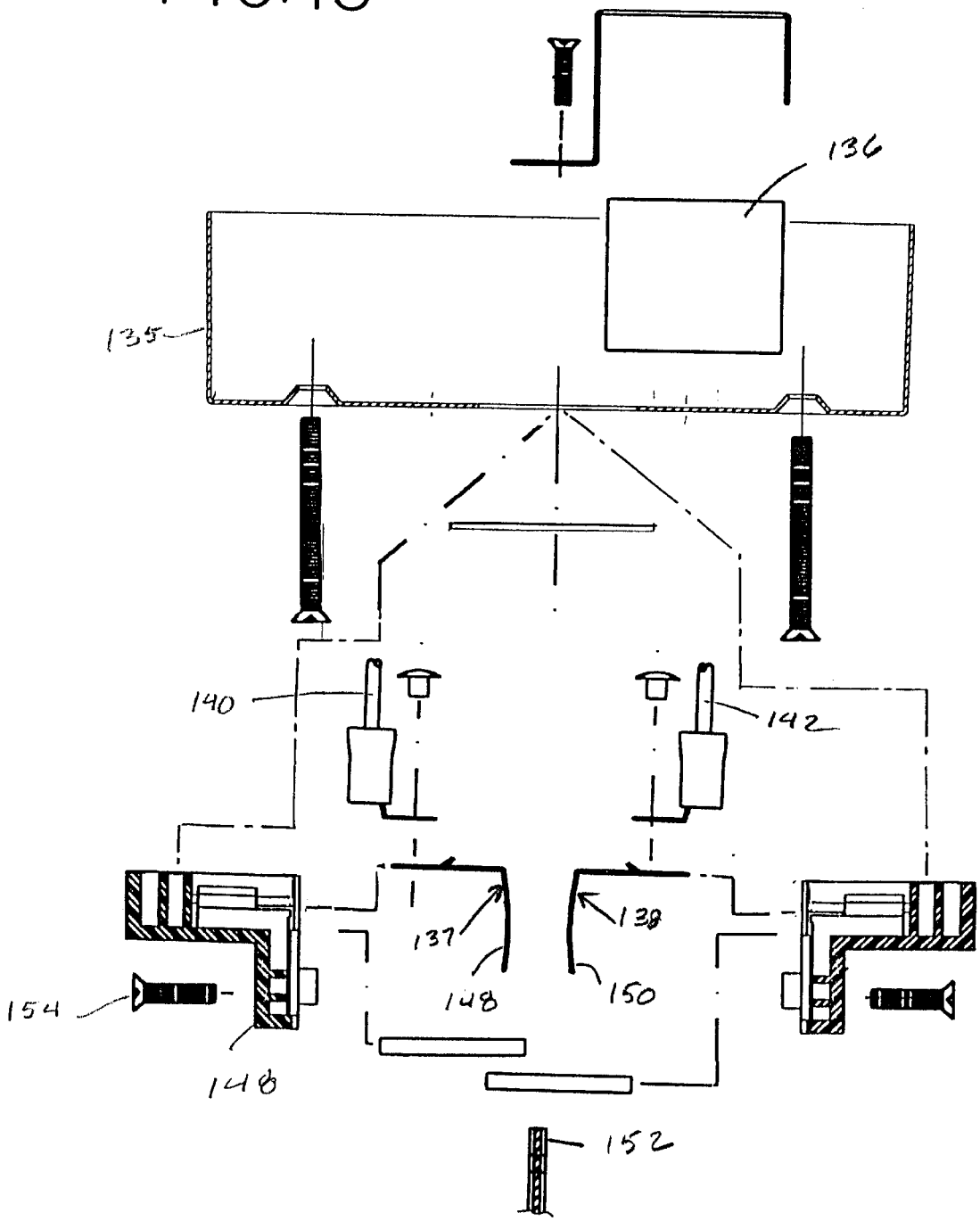
FIG. 13 is an exploded view of the ceiling feed mount of FIGS. 11 and 12.

The construction of a monopoint feed mount 134, which may be used as a ceiling mount or a wall mount, is shown in FIGS. 11, 12, and 13. FIGS. 11 and 12 show mount 134 secured to a ceiling, such as, ceiling 32. The monopoint includes a canopy 135 with a step down transformer 136 mounted therein. The step down transformer 136 is connected to a conventional source of electric power (which is not shown). An electric conductive path is connected to the transformer. The path includes contact assemblies 137 and 138 connected to the transformer through wires 140 and 142, respectively. Mount 134 includes a split housing 144 having a slot 146 formed therein. The contact assemblies 137 and 138 have resilient angle contacts 148 and 150 positioned in slot 146 of the housing. The contacts are offset from each other, as in the case of the ceiling feed mount, so that there is no electrical connection between the contacts when there is no track in the slot. A track 152 is mounted in the slot and is held in the slot by the frictional contact with the housing created by a pair of screws 154. The screws are tightened to secure the track in place. Once the track is in place, the conductors of the opposite sides of the track are electrically connected to contacts 148 and 150.

Figure 15:
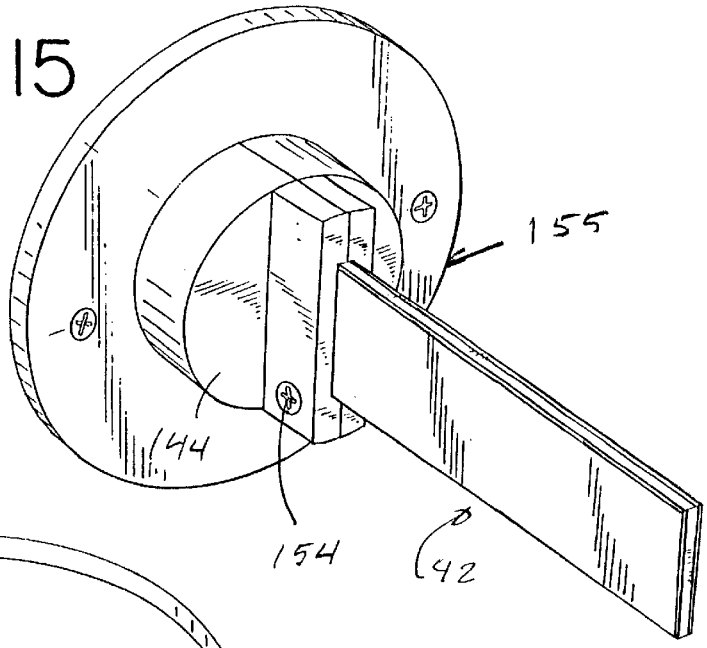
FIG. 15 is the mount of FIG. 14, but shown mounted in a wall rather than a ceiling into which any length of track can be inserted.
Figure 14:
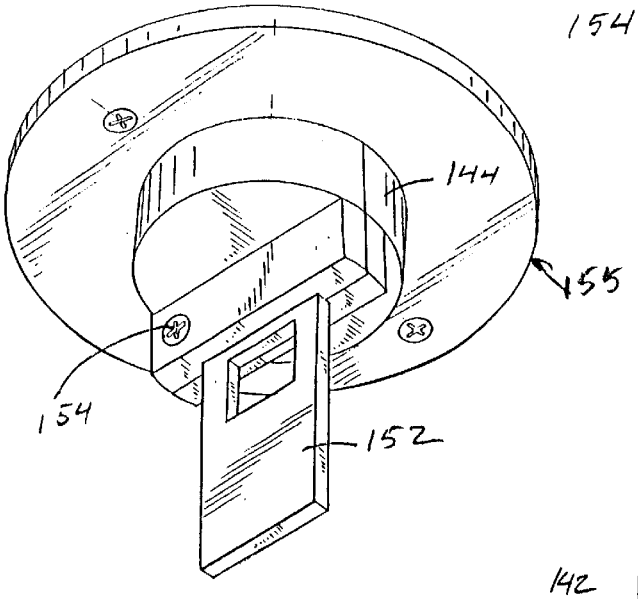
FIG. 14 is a ceiling feed mount similar to the mount shown in FIGS. 11 and 12, but with no step down transformer in the mount with a specially configured short section of track that accepts one low voltage lamp assembly.
Figure 16:
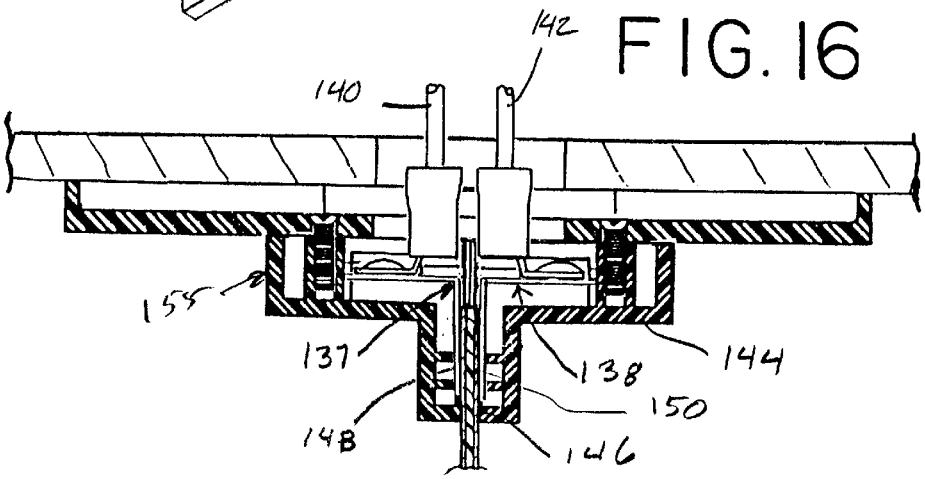
FIG. 16 is a cross sectional view through the mount of FIG. 14.
Figure 17:
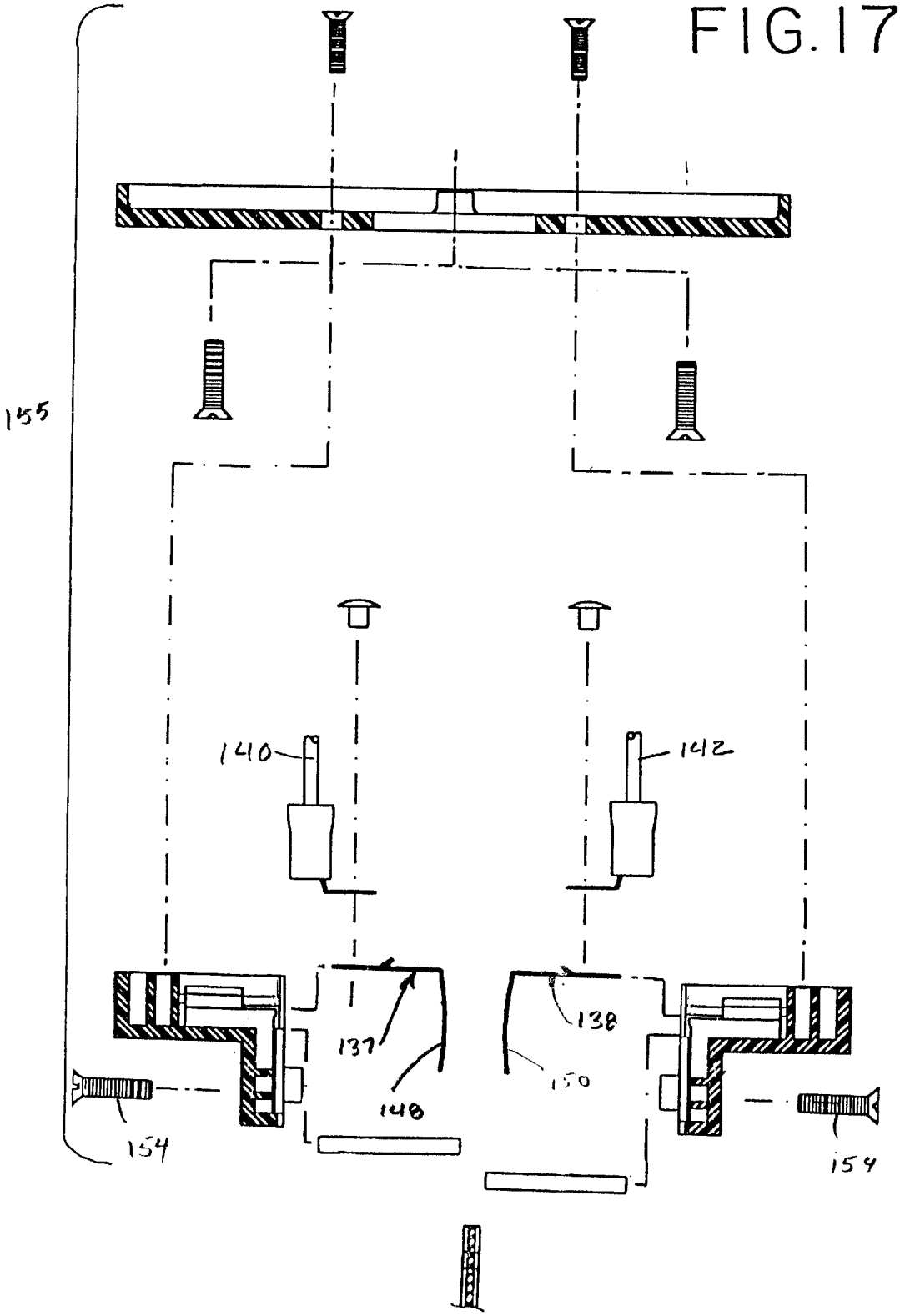
FIG. 17 is an exploded view of the mount of FIG. 14.

As may be seen in FIG. 15, a wall mount 155 is shown rotated 90°, so that it is mounted on wall 40 and wall 34 to support the ends of the tracks. The construction of wall mount 155 is similar to the construction of mount 134, but the step down transformer is positioned externally of the mount. Like numbers are used for like parts of mounts 134 and 155.

Figure 24:
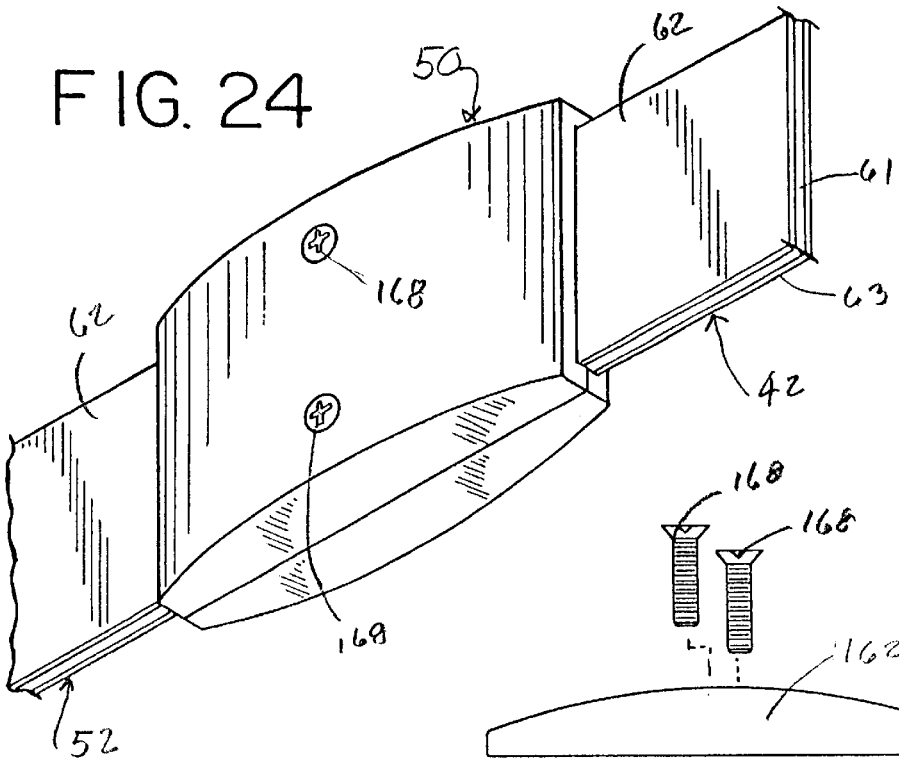
FIG. 24 is a perspective view of a link between abutting ends of two tracks.
Figure 25:
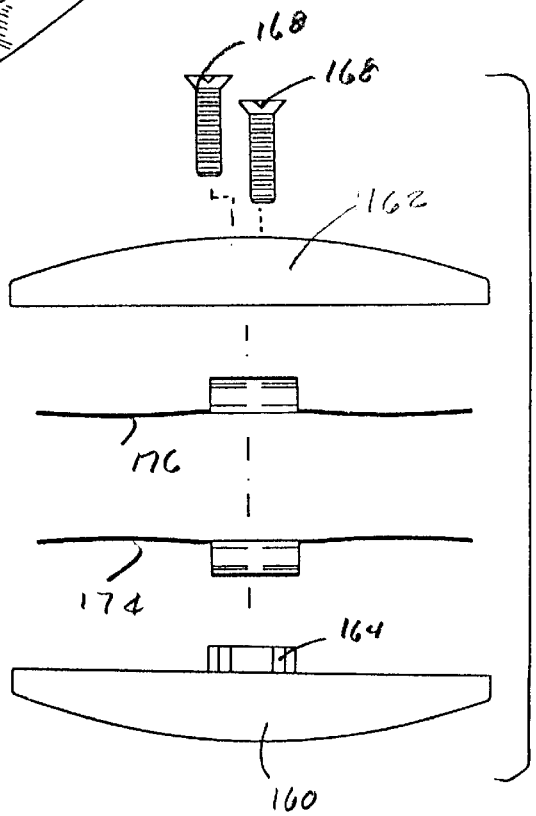
FIG. 25 is an exploded view of the link of FIG. 24.
Figure 26:
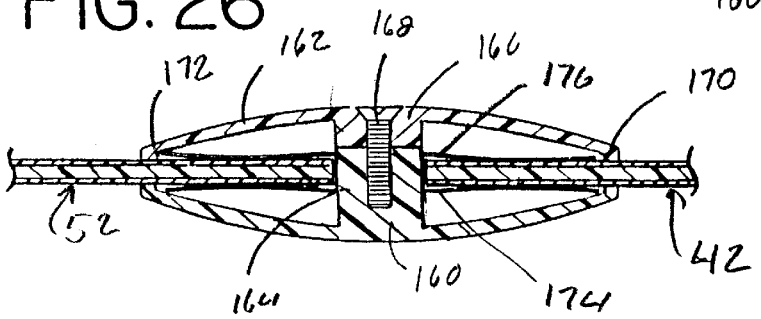
FIG. 26 is a cross sectional view through the body of the link showing two tracks abutting and electrically connected.
Figure 1:
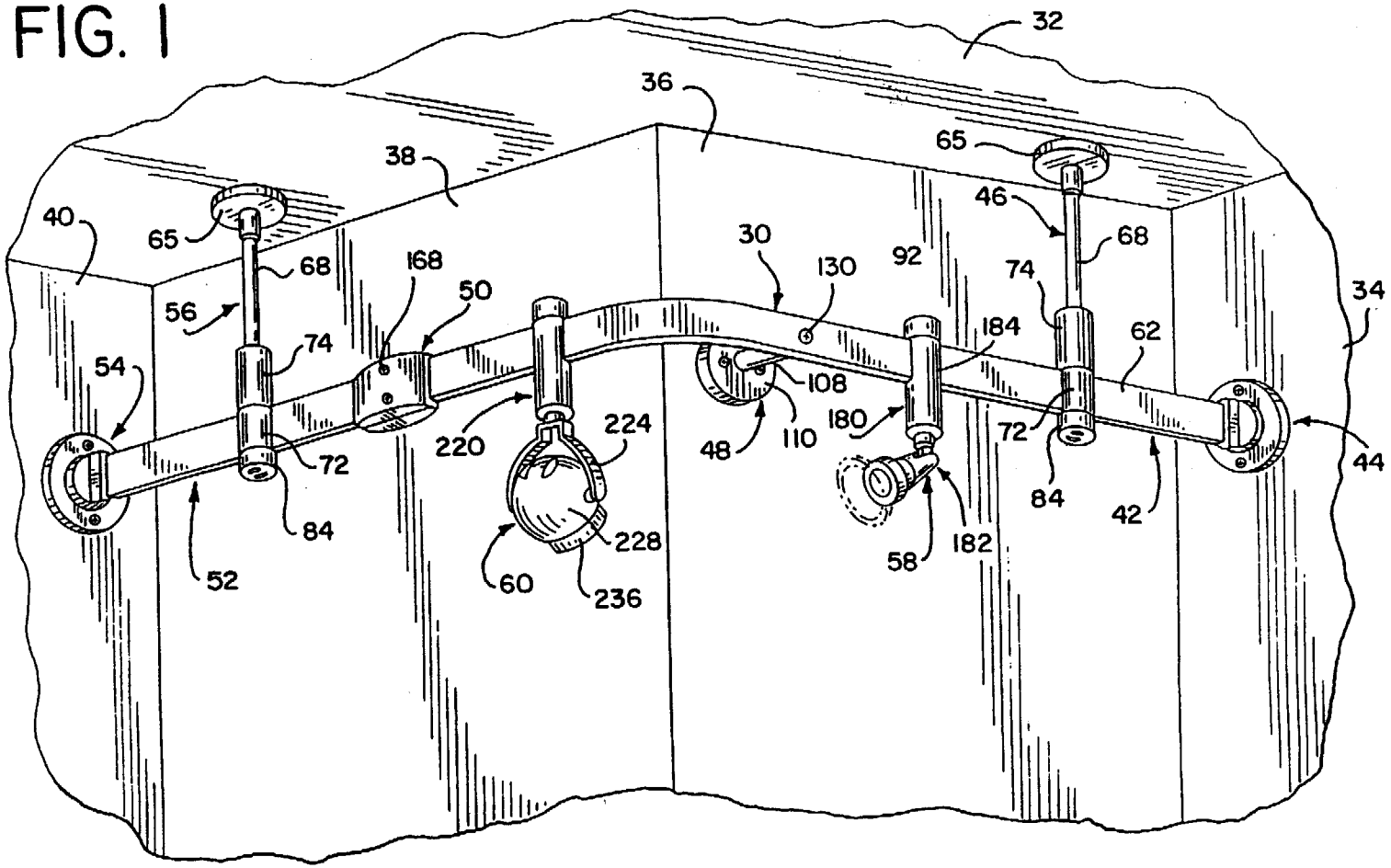
Figure 4:
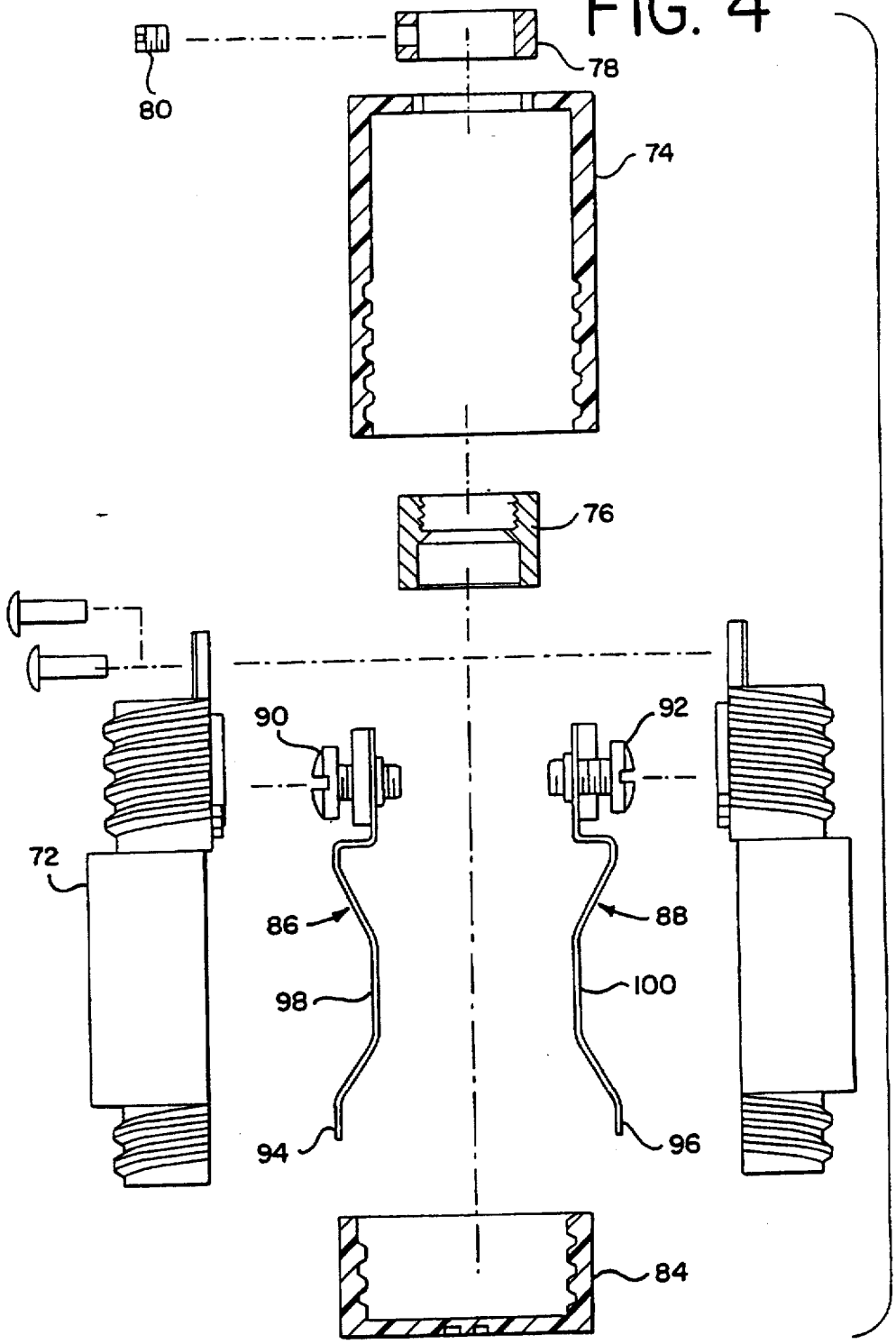
Figure 5:
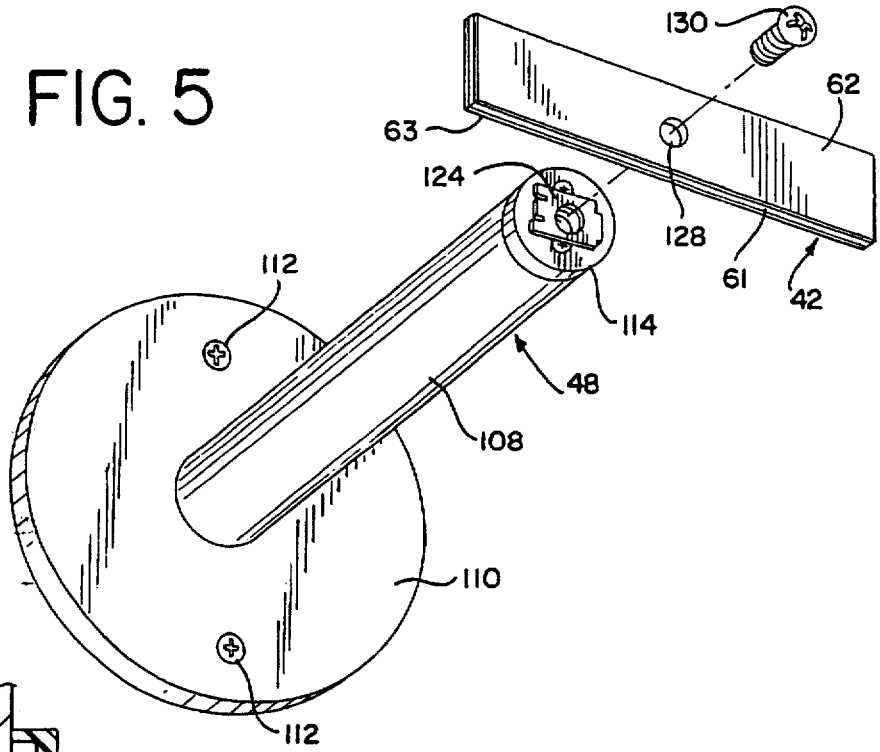
Figure 6:
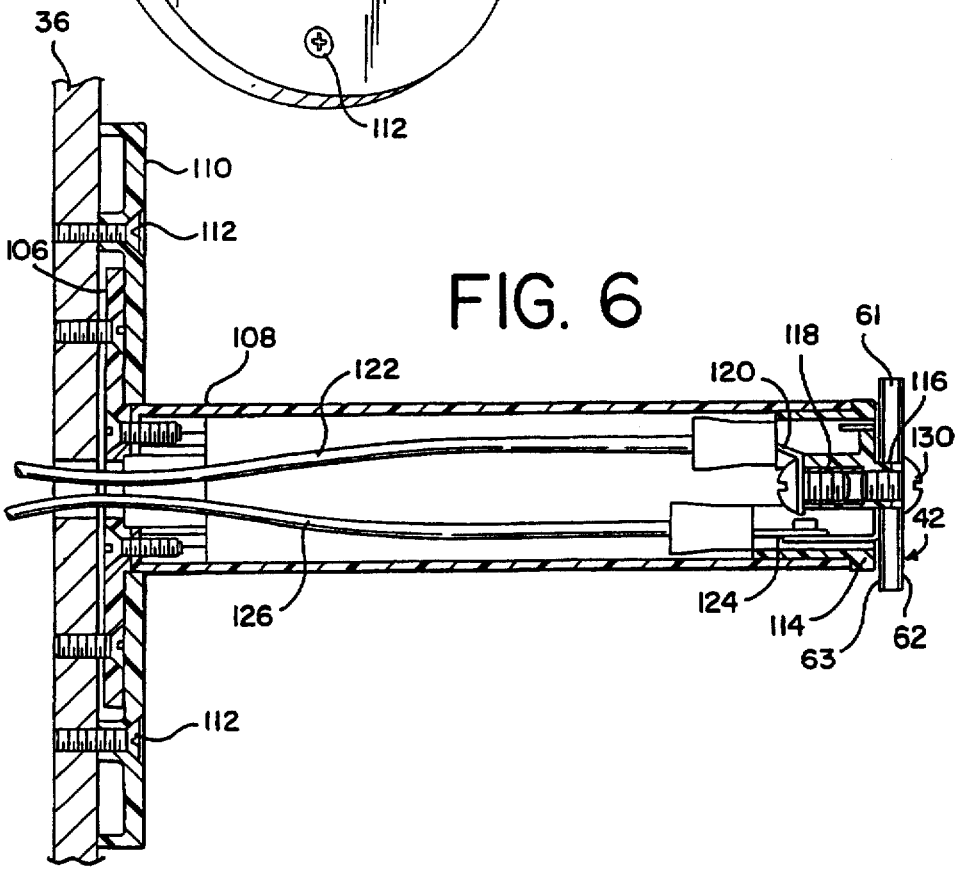
Figure 7:
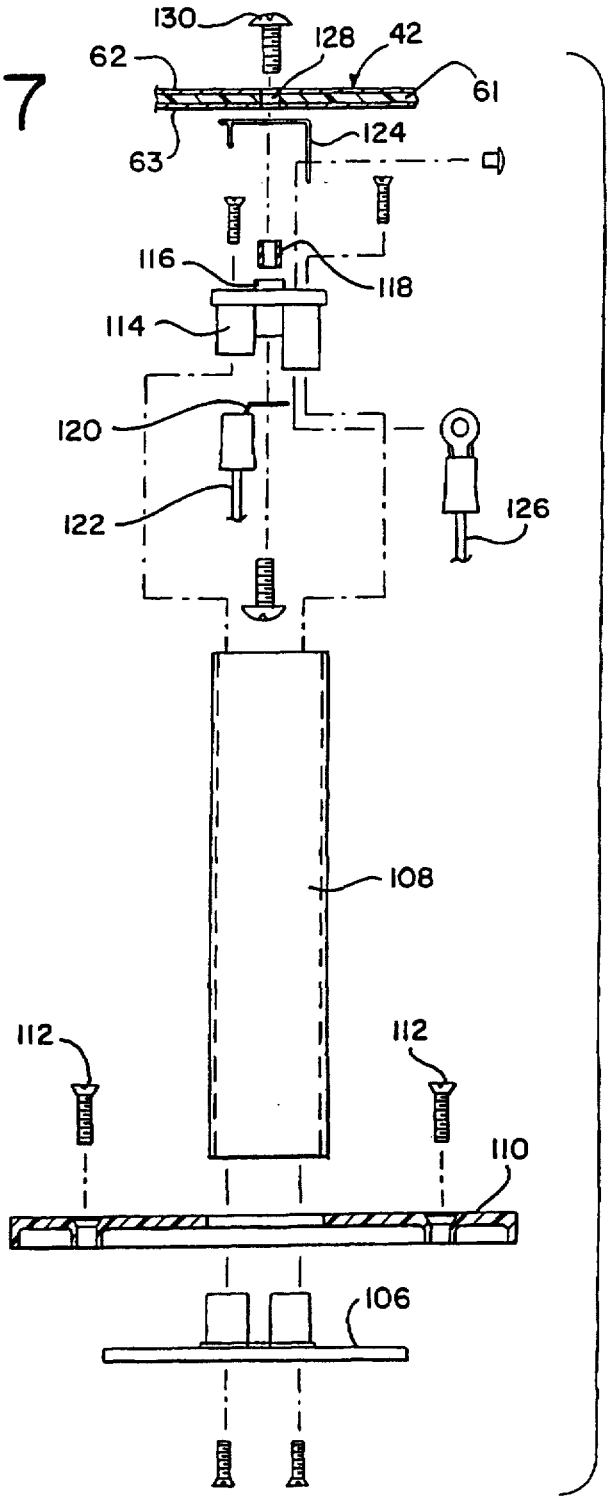
Figure 8:
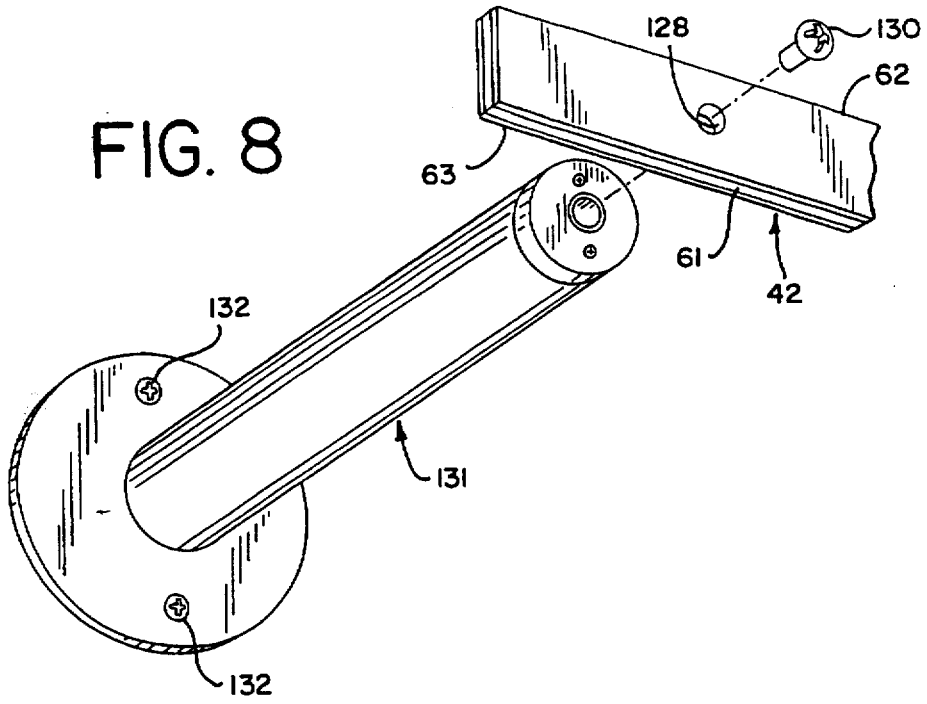
Figure 9:
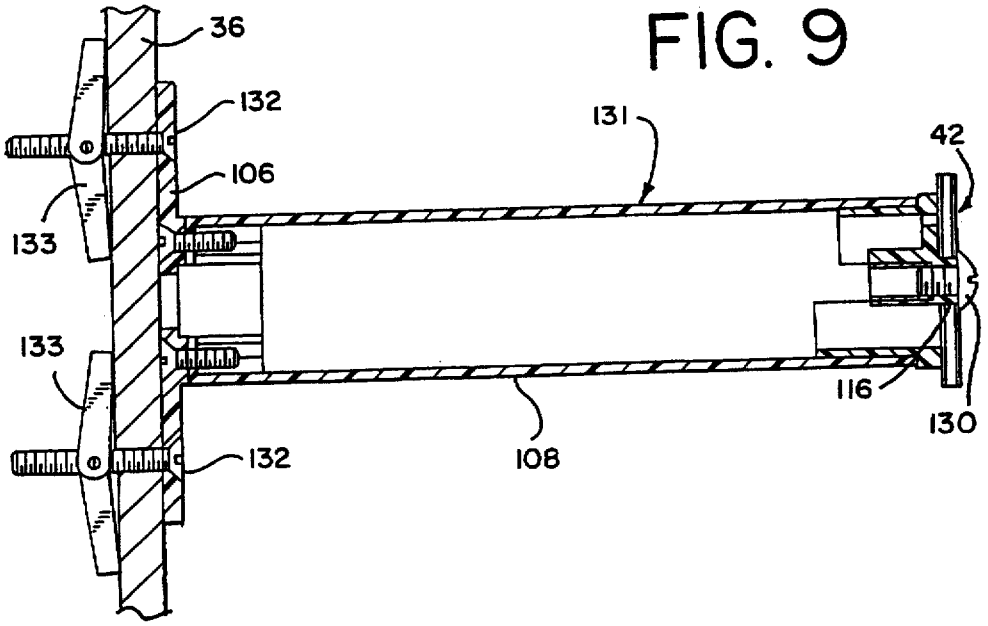
Figure 11:
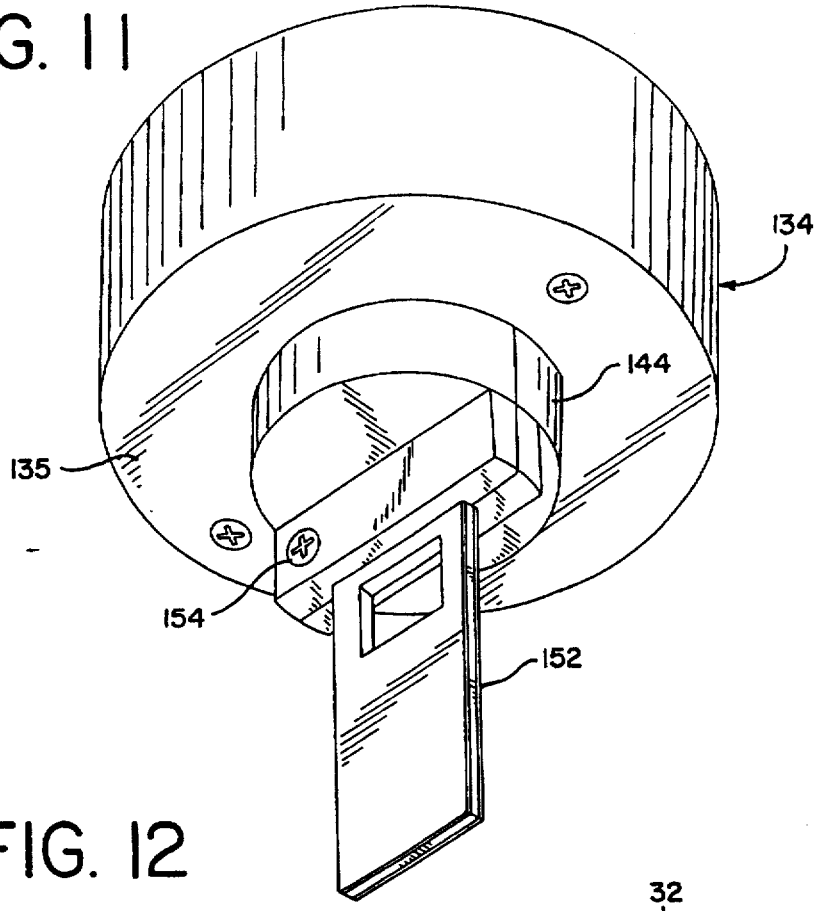
Figure 12:
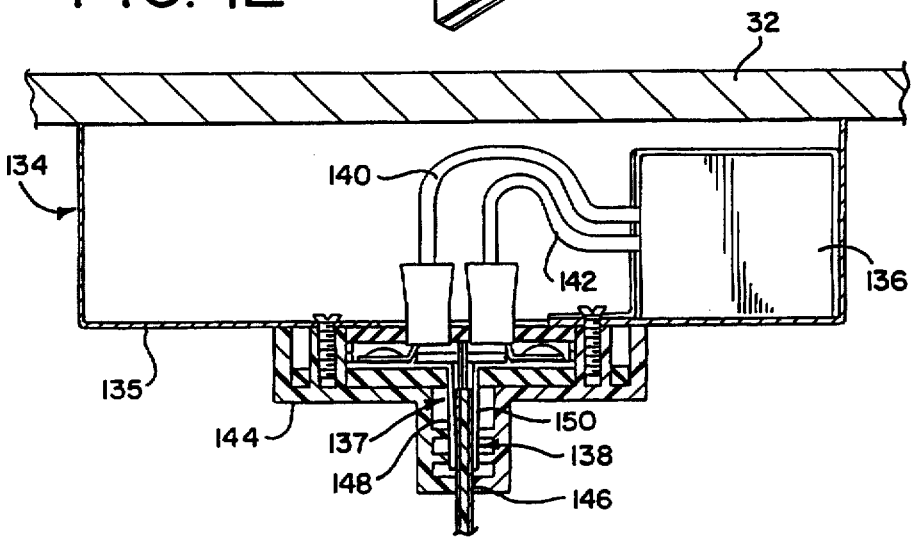
Figure 13:
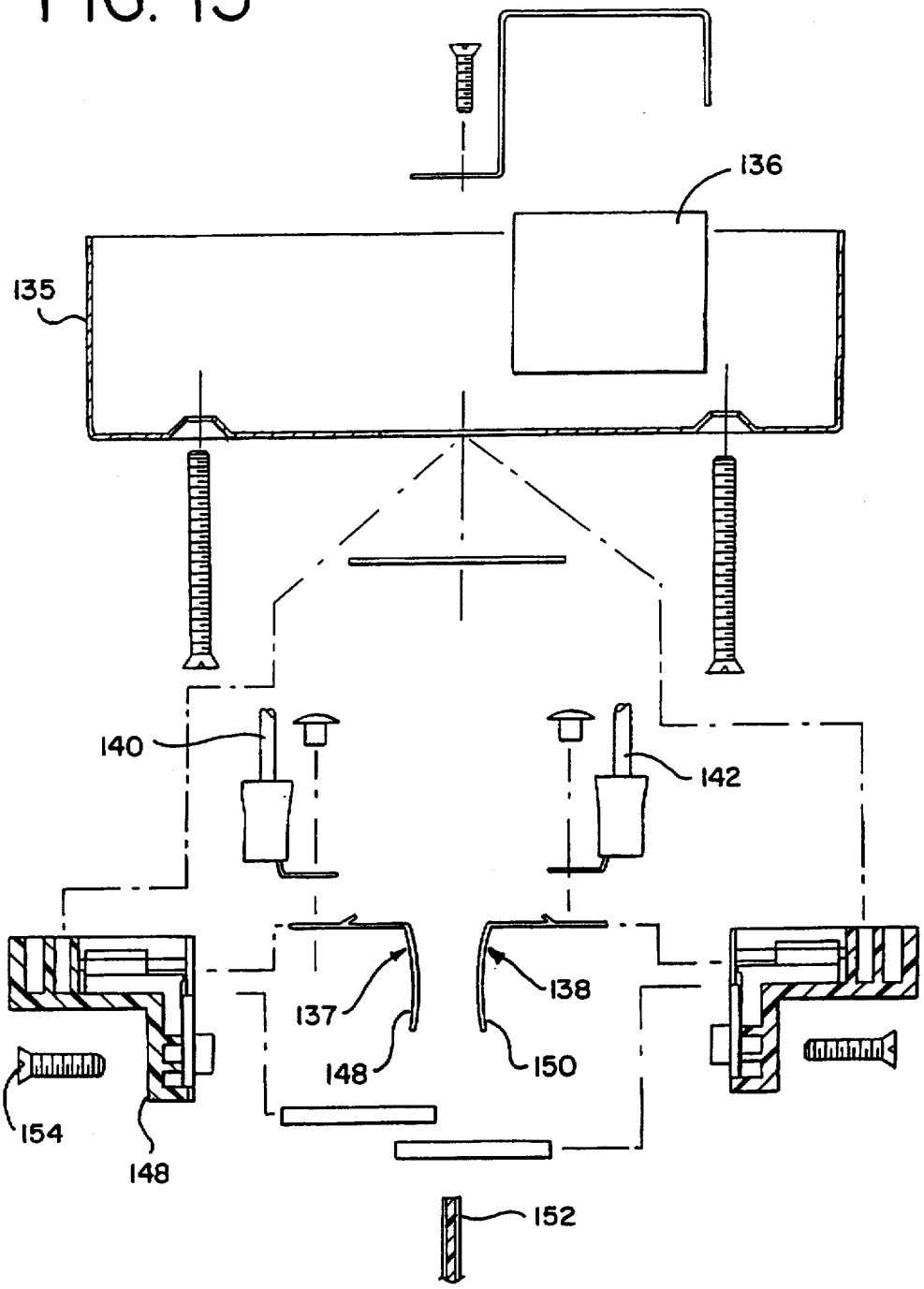
Figure 15:
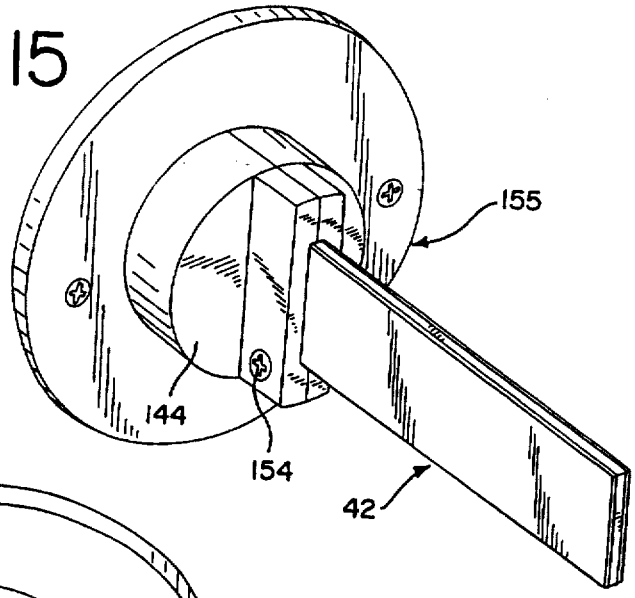
Figure 14:
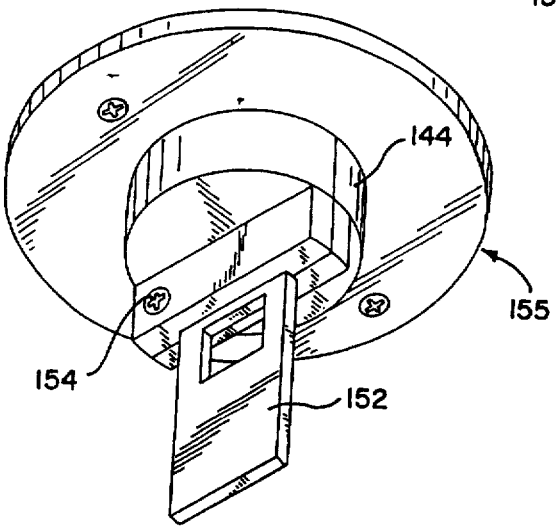
Figure 16:
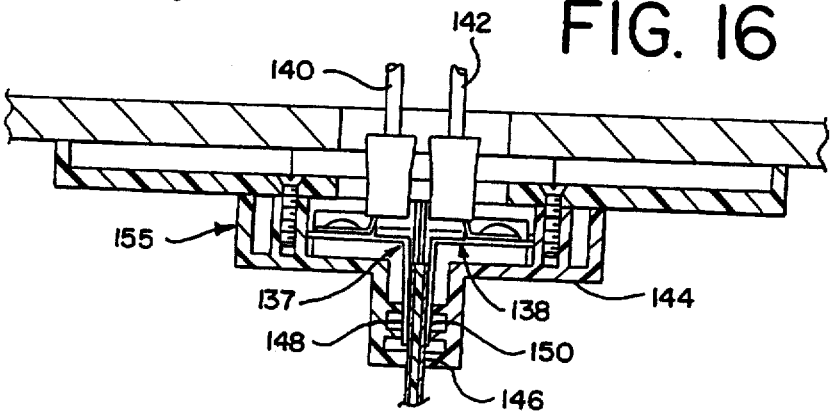
Figure 17:
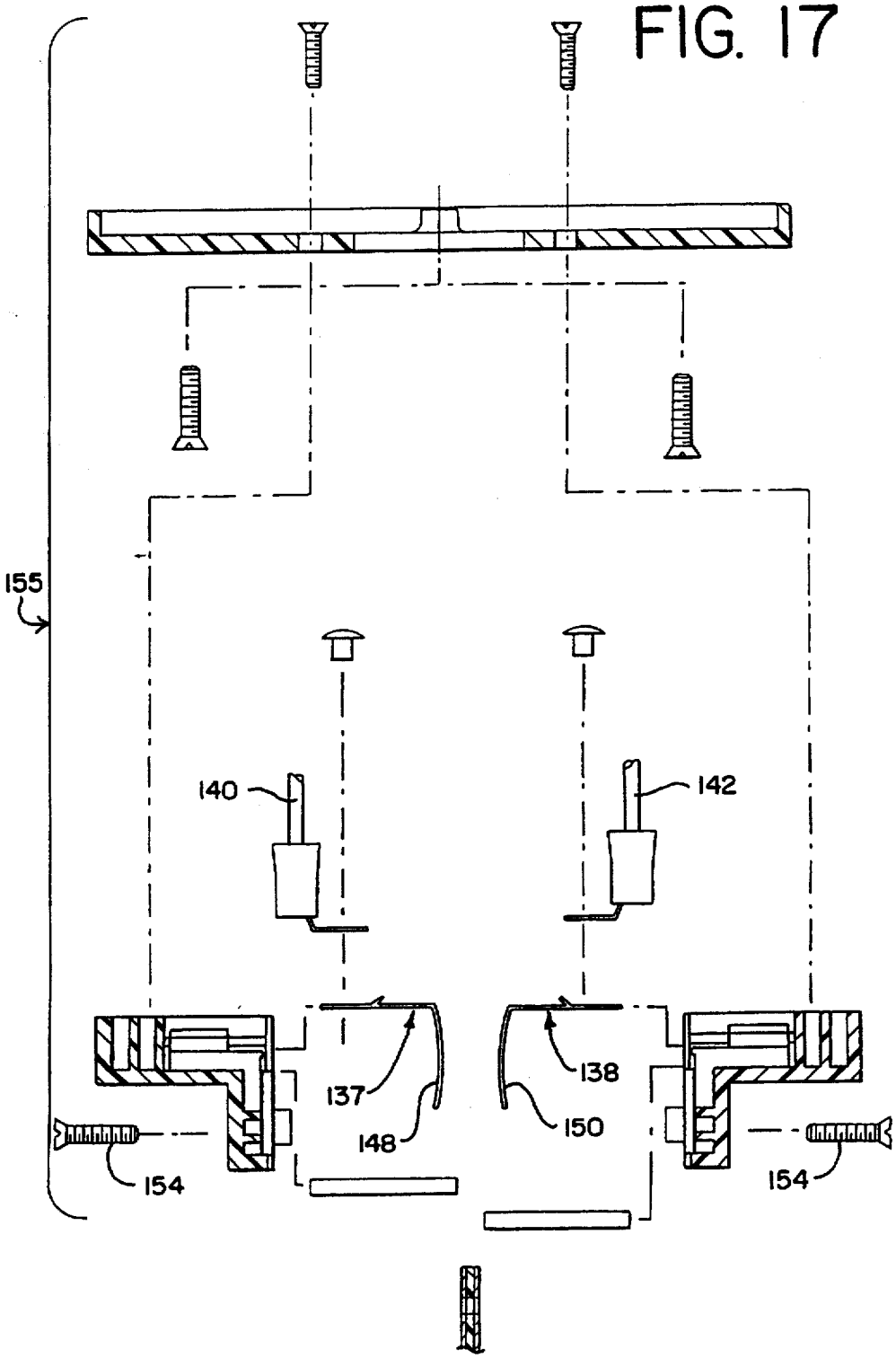
Figure 19:
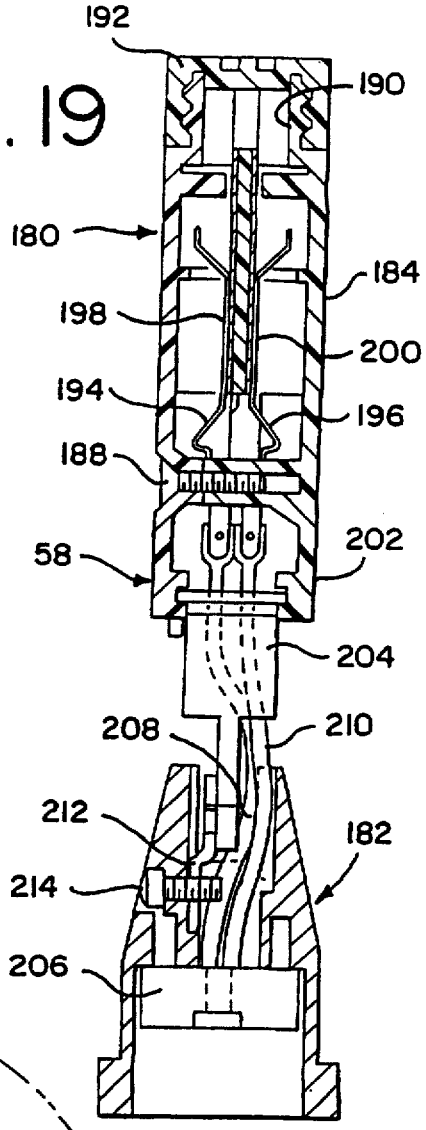
Figure 18:
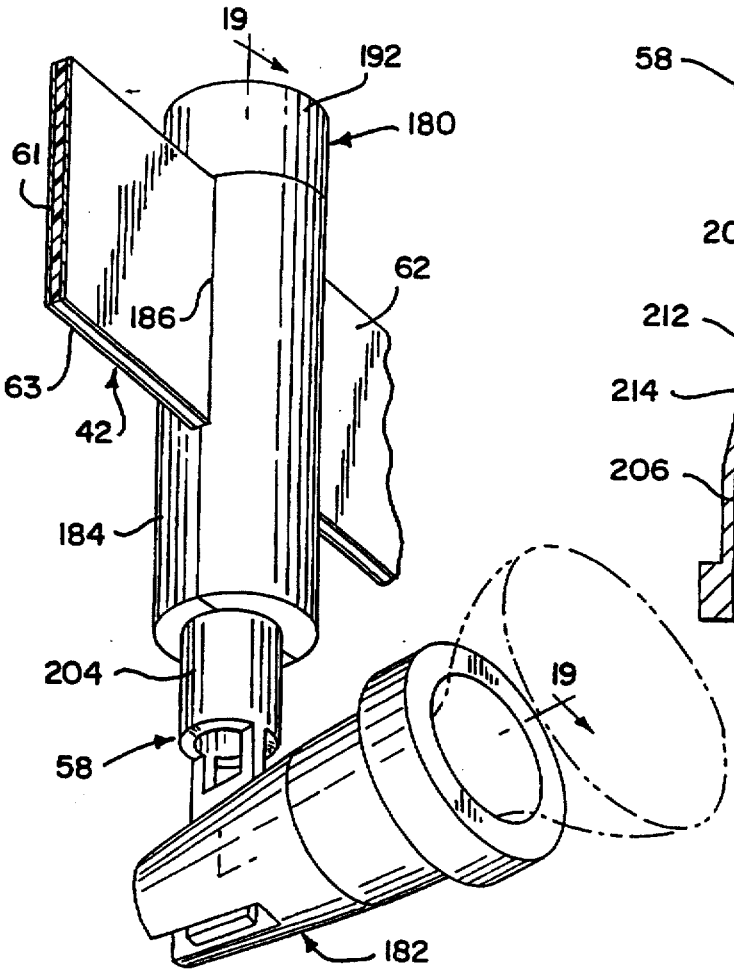
Figure 20:
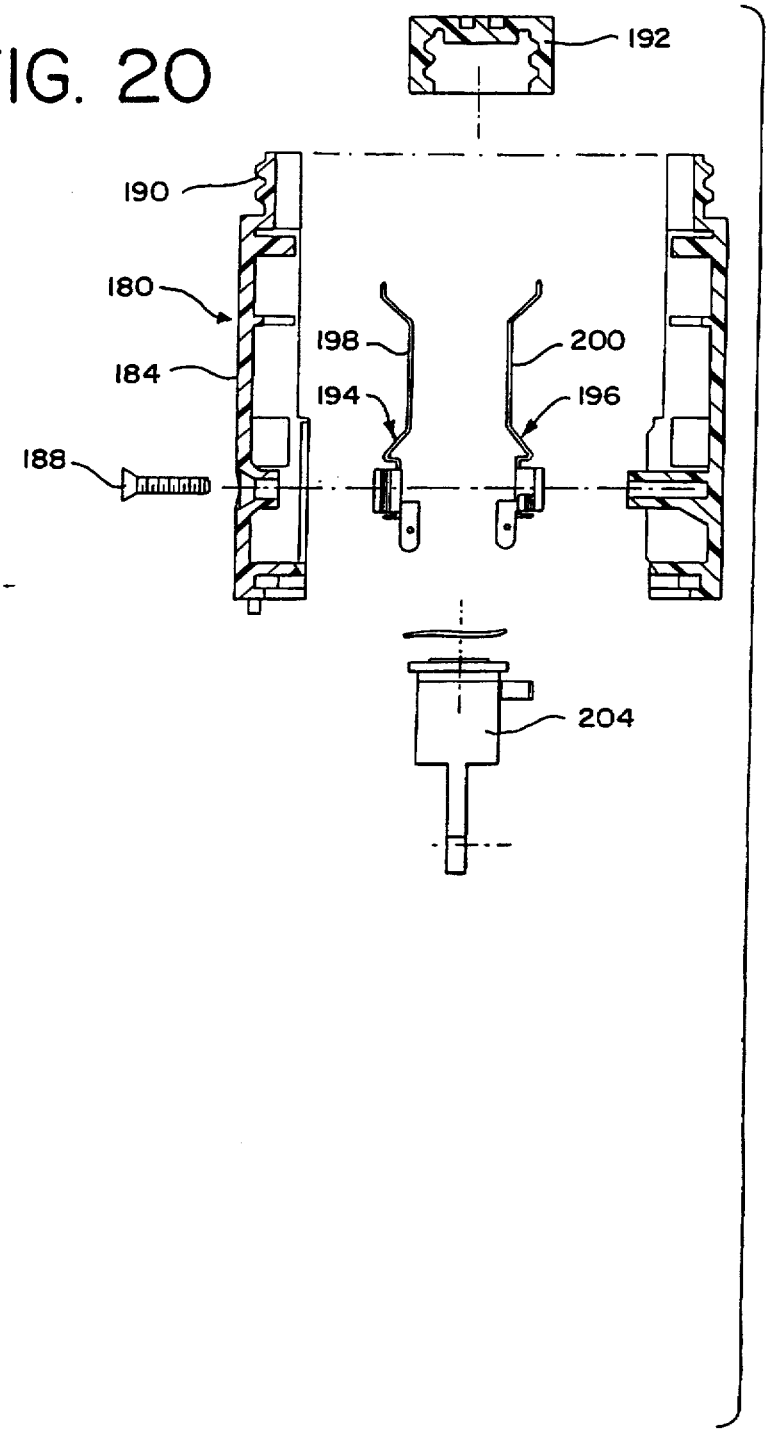

Link 50 is shown in FIGS. 24, 25, and 26. Link 50 includes an insulator body having a male portion 160 and a female portion 162. The male portion has a pair of bosses 164 which abut mounts 166 in female portion 162. A pair of screws 168 are threadedly mounted in bosses 164 to hold the halves together. The screws are tightened to secure butt ends of tracks 52 and 42 together by frictional contact. The halves form a slot opening 170 at one end and a second slot opening 172 at the other end to receive butt ends of tracks 52 and 42. A pair of electrical connector clips 174 and 176 are mounted within the housing. Clips 174 and 176 are mounted between bosses 164 and are in contact with respective sides of the tracks, so that there is an electrical connection between adjacent abutting conductors of the track.

Figure 19:
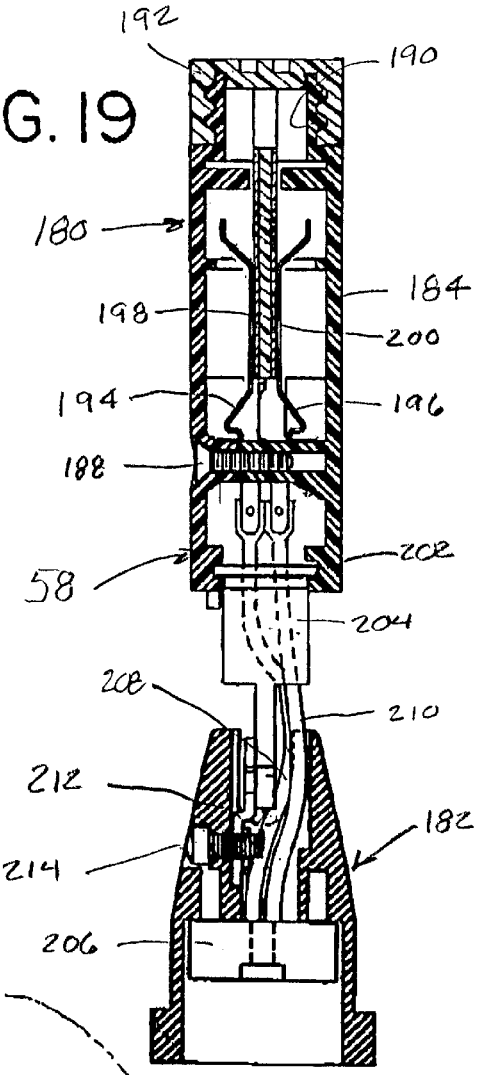
FIG. 19 is a cross sectional view taken on Line 19—19 of FIG. 18.
Figure 18:
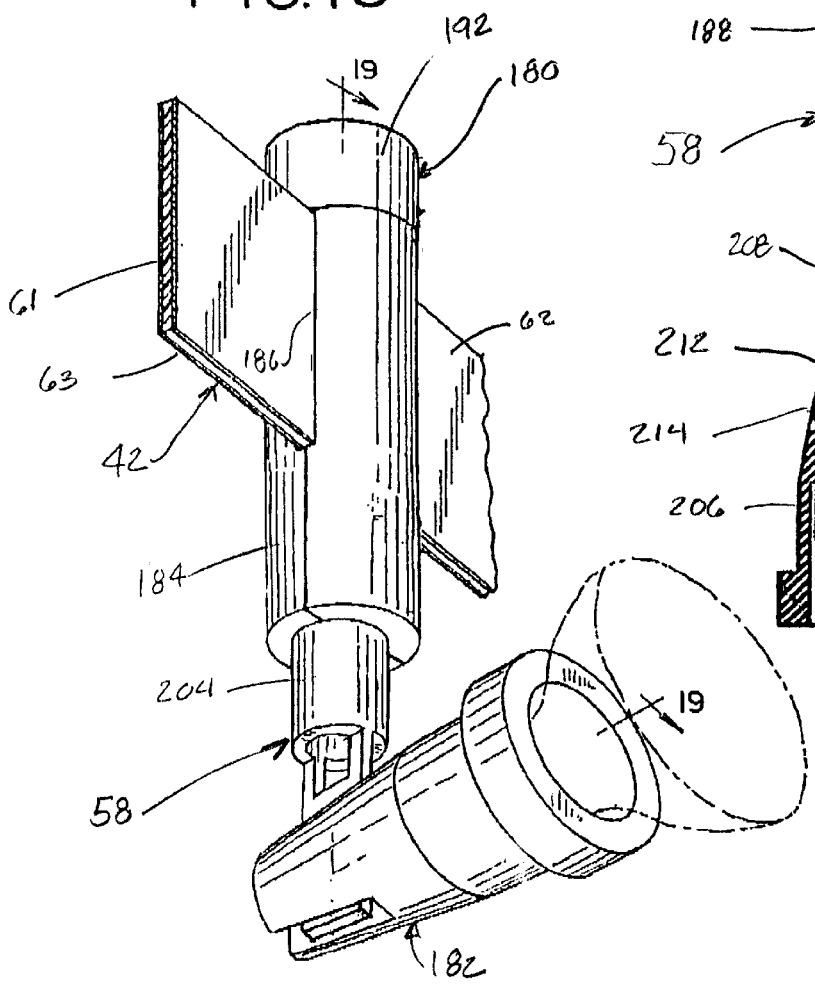
FIG. 18 is an enlarged perspective view of a low voltage lamp assembly shown in FIG. 1.
Figure 20:
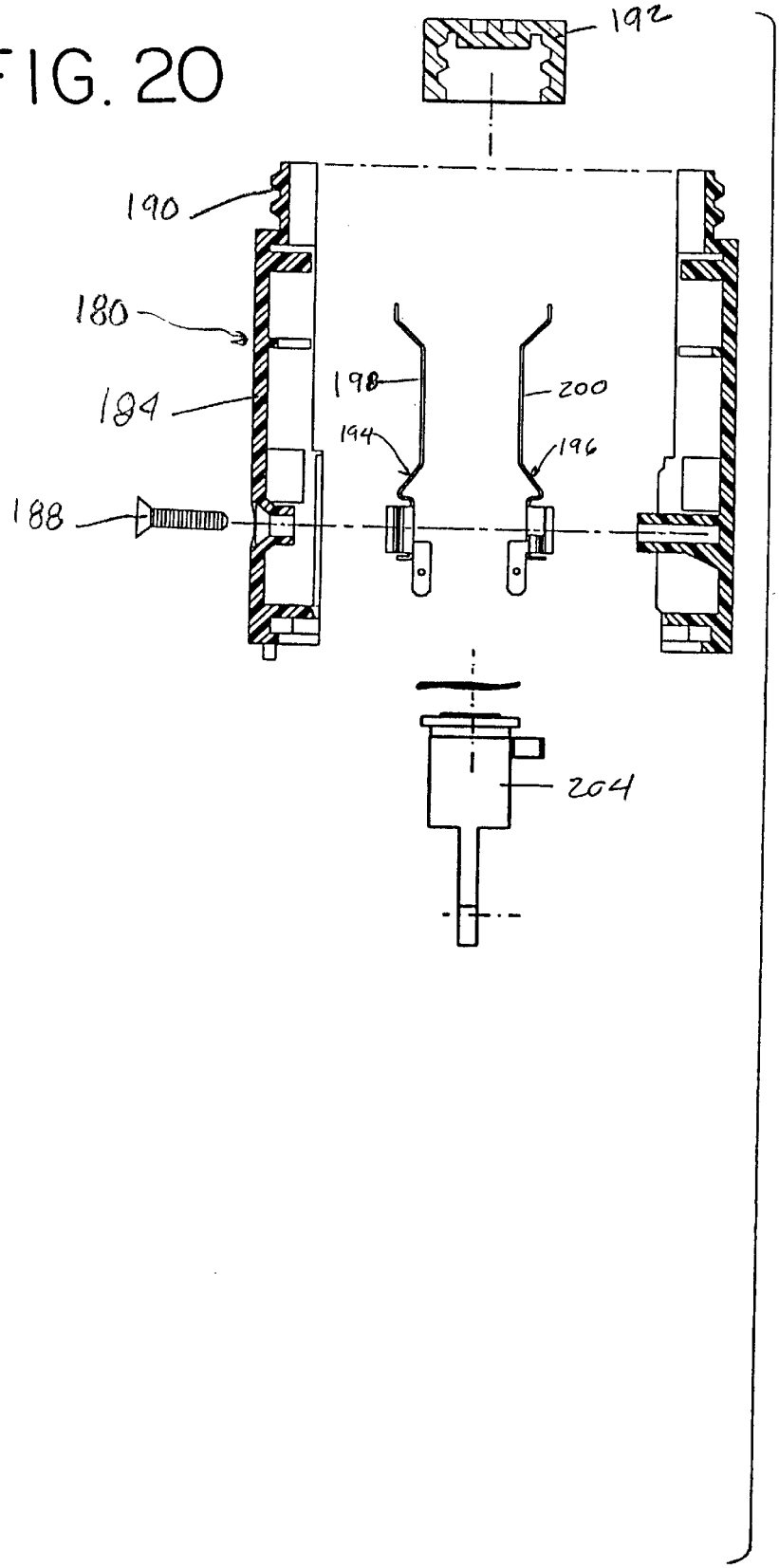
FIG. 20 is an enlarged exploded view of an adapter of FIG. 19.

Lamp assembly 58 is best seen in FIGS. 18, 19, and 20. Lamp assembly 58 includes a fixture adapter 180 and a lamp holder 182. The adapter includes a split adapter housing 184 having a track slot 186 formed therein. The halves of the housing 184 are held together by a conventional screw 188. Slot 186 extends through the housing and opens at the upper end of the housing, as viewed in FIGS. 18 and 19. The housing has a threaded portion 190 which receives support cap 192. The support cap closes the open end of slot 186. A pair of resilient lamp contacts 194 and 196 is mounted in the housing. Each of the lamp contacts 194 and 196 has flat portions or elongated pads 198 and 200, respectively. The housing includes a mounting groove 202, which has a yoke 204 rotatably mounted therein. The yoke 204 is pivotally connected to lamp holder 182. Lamp holder 182 has a conventional lamp socket 206 mounted therein. The lamp socket is connected to the contacts 194 and 196 through conventional wires 208 and 210. The lamp holder includes a pivot bracket 212 held therein by screw 214.

The adapter is mounted on track 42 by placing track 42 into slot 186, then screwing support cap 192 onto the threaded portion 190 to lock the track into the adapter. The flat portions 198 and 200 of the contacts 194 and 196, respectively, are in electrical connection with the respective conductors of the track. A low voltage lamp is mounted in socket 206 to be energized by the low voltage current flowing in the track.

Figure 23:
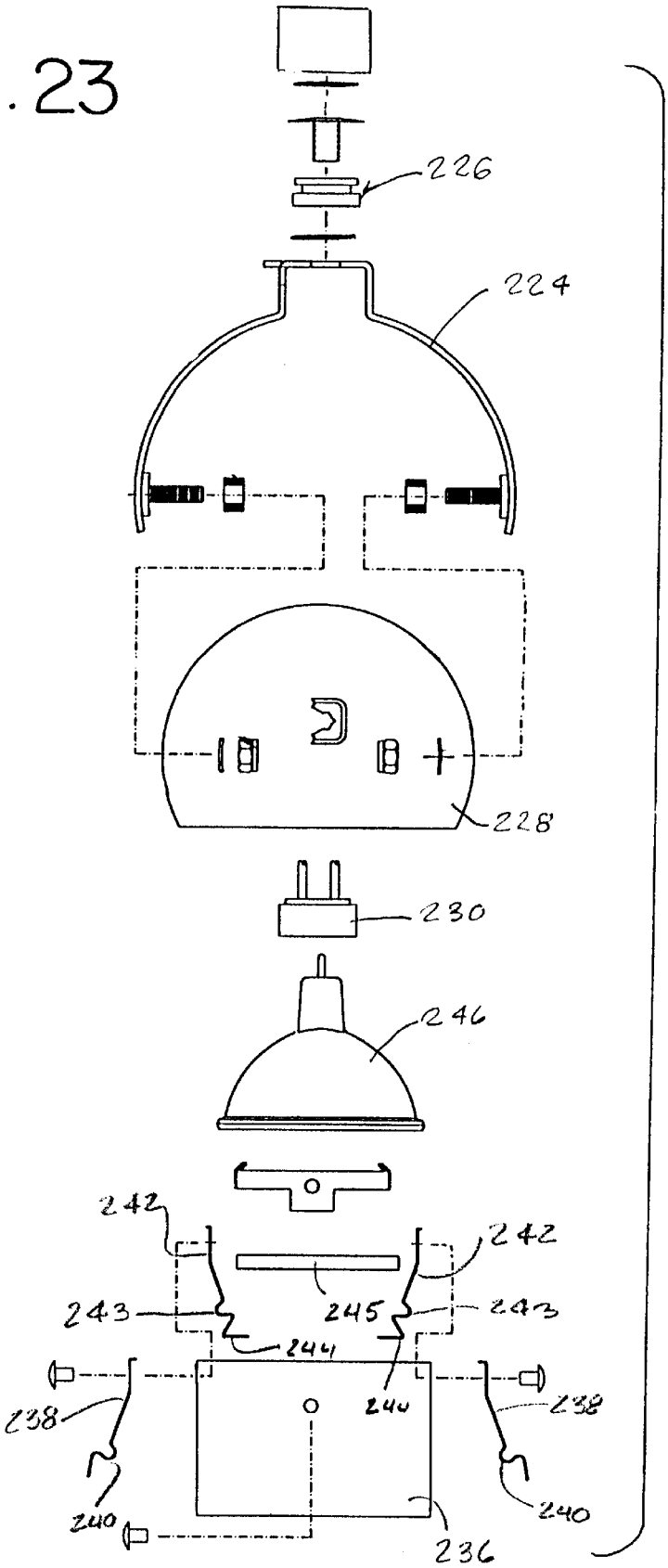
FIG. 23 is an exploded view of the parts of the spherical lampholder of FIG. 21.
Figure 21:
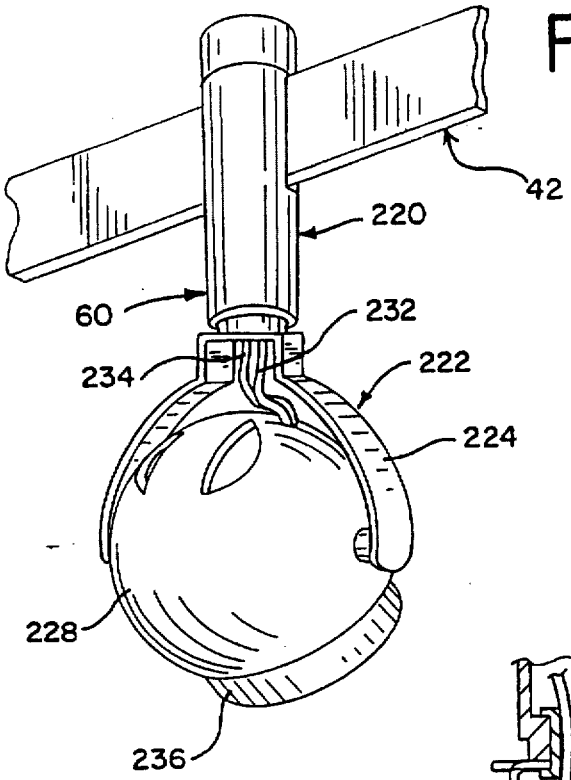
FIG. 21 is an enlarged perspective view of a spherical lamp assembly shown in FIG. 1.
Figure 22:
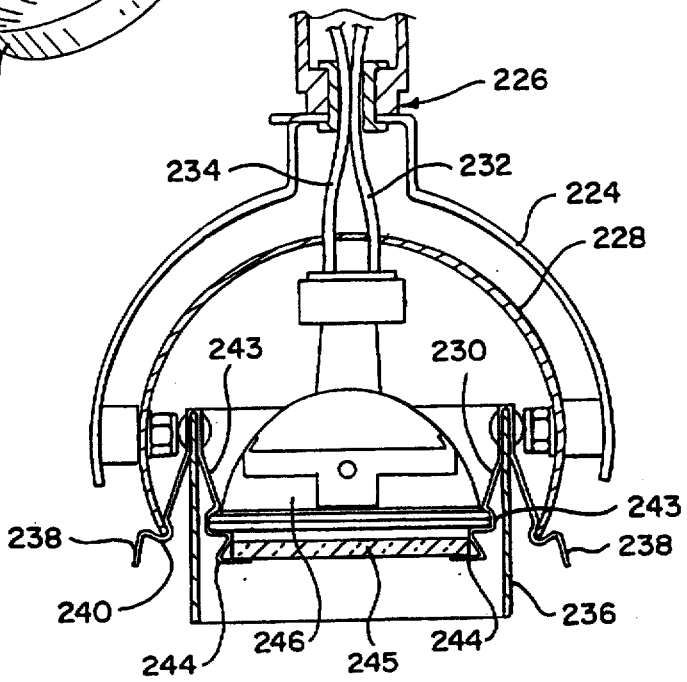
FIG. 22 is a cross sectional view taken through the lampholder of FIG. 21.
Figure 23:
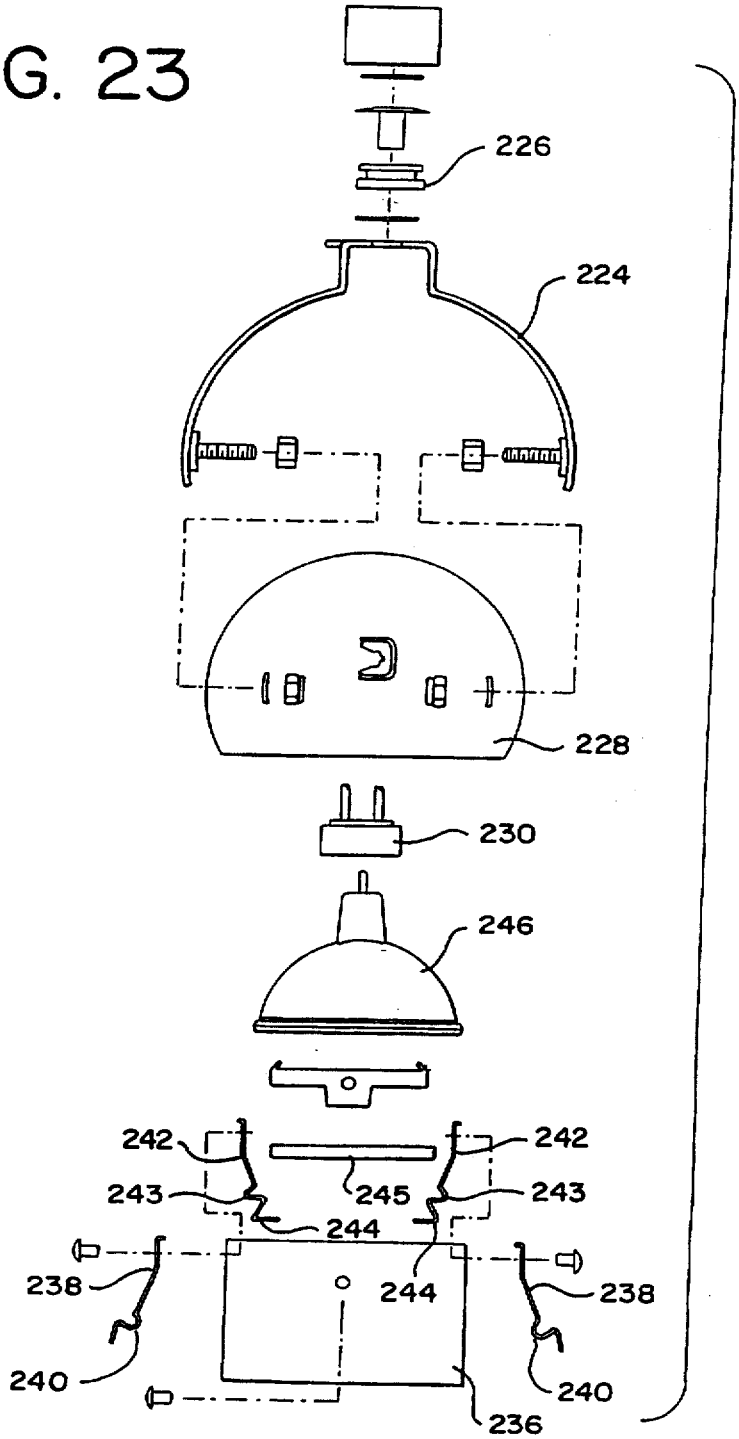
Figure 24:
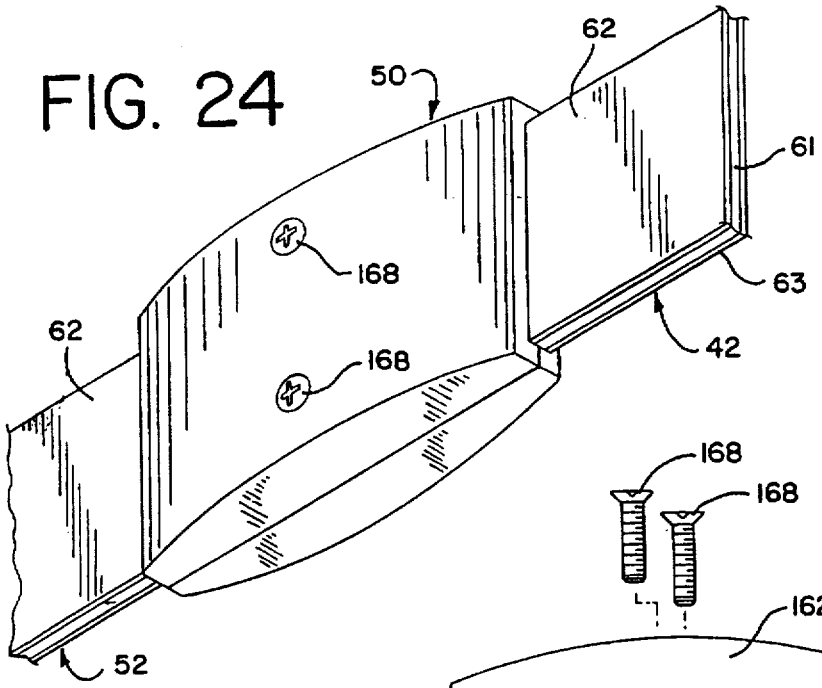
Figure 25:
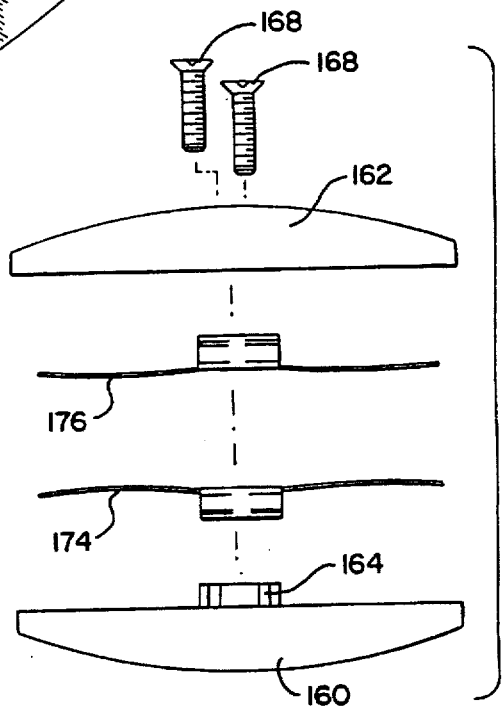
Figure 26:
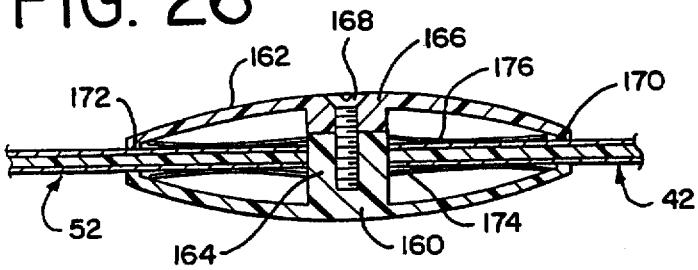

The construction of lamp assembly 60 is shown in FIGS. 21, 22, and 23. Lamp assembly 60 includes an adapter 220, which is identical in construction to adapter 180. A lamp holder 222 is mechanically and electrically connected to adapter 220. The entire lamp holder 222 includes a fork 224 connected to the adapter through a connector assembly 226. A shell 228 is pivotally mounted on fork 224. The shell has a lamp socket 230 mounted therein. The socket is connected to the contacts in the adapter through conventional wires 232 and 234. A tubular shield 236 is held in shell 228 by three resilient spring shield fingers 238. Each of the resilient fingers has one end fixed to the shield and the other end includes a hook portion 240, which engages shell 228. Three resilient spring lamp fingers 242 are mounted on the inside of the shield. Each finger has a lamp hook 243, which engages a conventional 12-volt lamp 246 to support the lamp. Each finger has a lens hook 244 which engages a conventional protective lens 245 to hold lens 245 a short distance from face of lamp 246 allowing air flow to cool the lamp. The lamp is surrounded by the shield so that heat generated by the lamp is largely absorbed by shield 236. The spacing of the lamp from the shield and the spacing of the shield from the shell allows air to flow around the shield and the lamp to carry away heat to cool the lamp.

It may be appreciated that the tubular shield may be readily removed from shell 228 simply by releasing resilient fingers 238. Upon removal of the shield, releasing clips 242 allows the lamp to be removed from the shield. The socket can now be removed for re-lamping.

Figure 8:
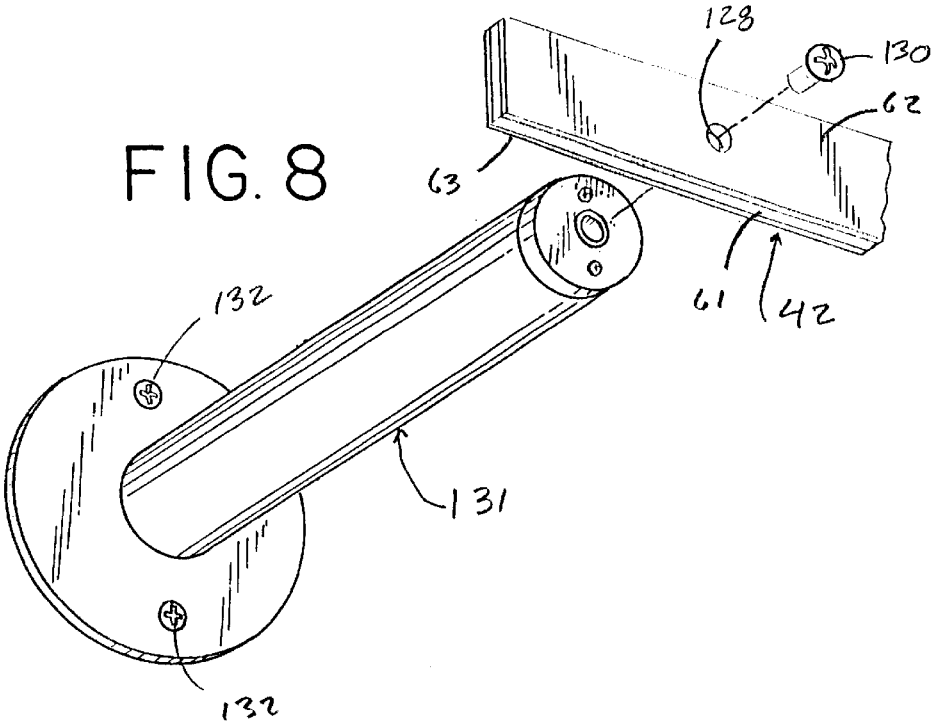
FIG. 8 is a perspective view of an outrigger mount similar to the mount of FIG. 5.
Figure 9:
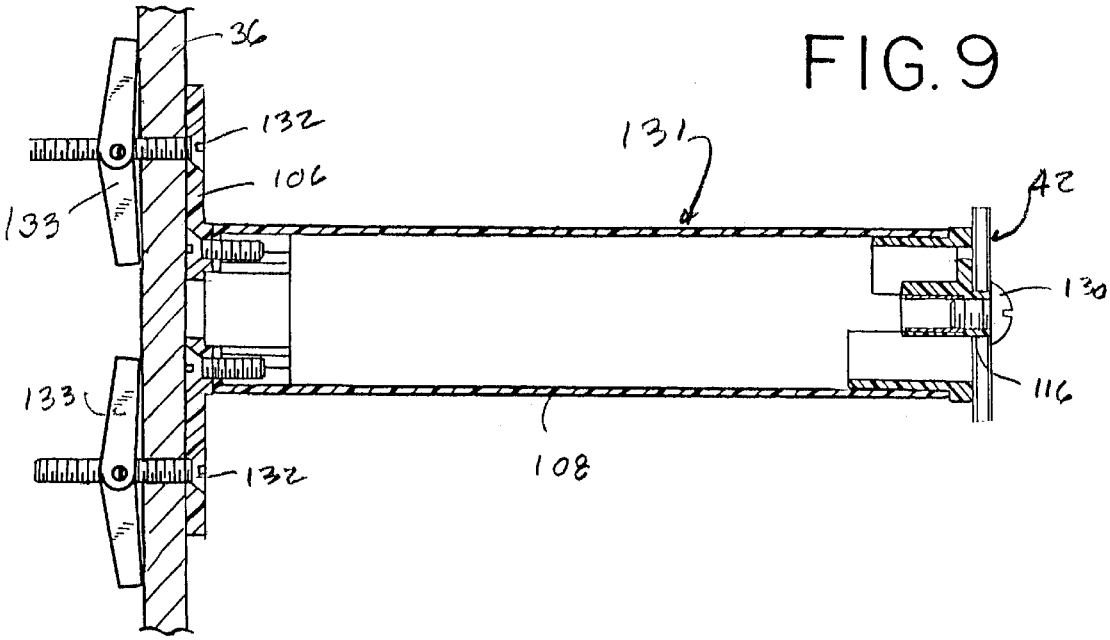
FIG. 9 is a cross sectional view of the mount of FIG. 8.
Figure 10:
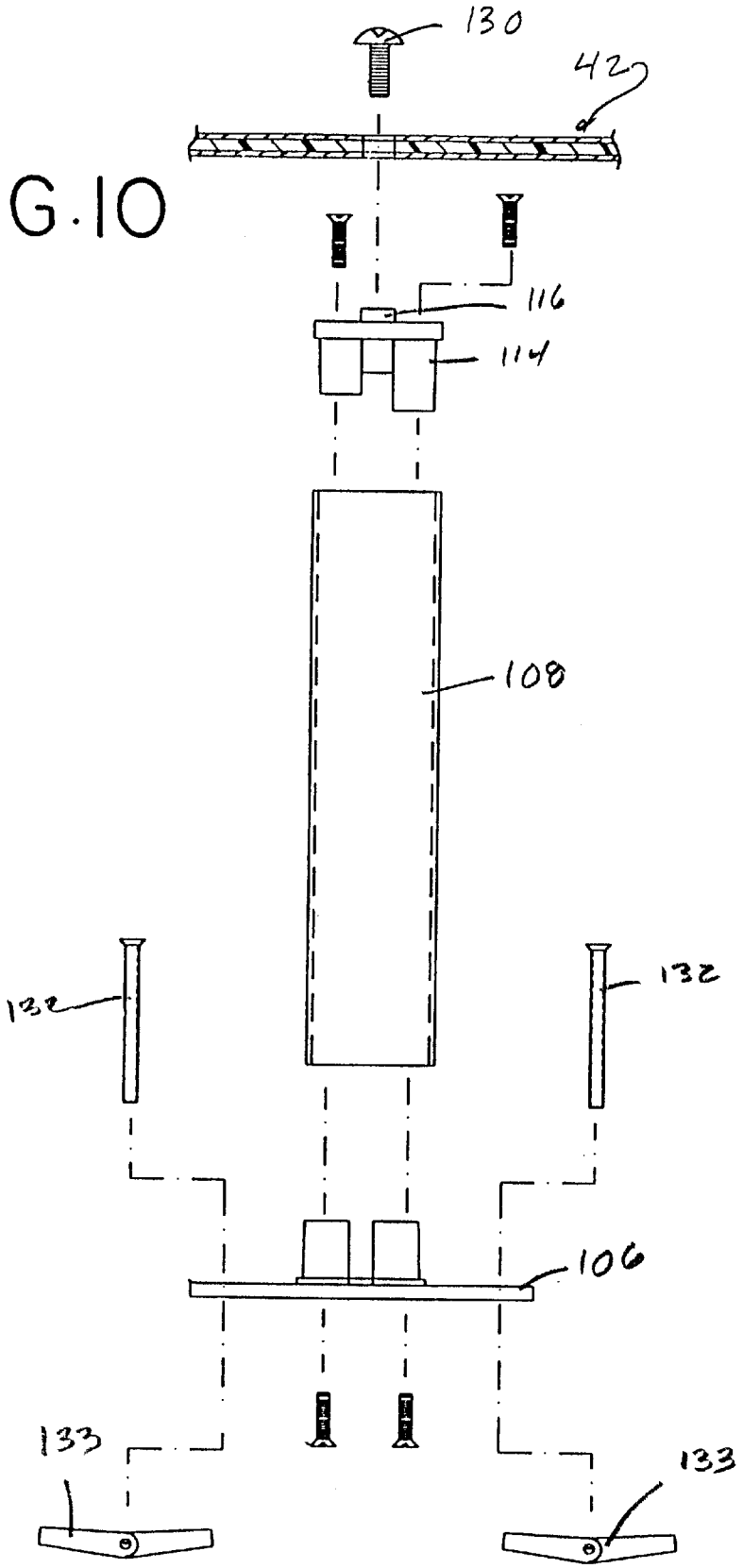
FIG. 10 is an exploded view of the mount of FIGS. 8 and 9.

The lamps may be positioned anyplace along the tracks simply by removing the lock caps and disengaging the adapter body from the track. Inasmuch as the voltage operating through the track is only a low voltage of 12 volts, or other low voltage, it is possible for a person who does not have any training as an electrician to move the lamps or to add lamps without being in any danger. The low voltage is safe for even those who are not experienced in electrical matters. In the event that it is necessary to provide additional mechanical support to the tracks, the various supporting devices may be used without the electrical contacts in the mount. The electrical feed cylinder assembly 70 may be utilized without the electrical contacts thereby providing only mechanical connection of the track to the ceiling. As mentioned above, the outrigger may be utilized without the electrical contacts, as shown in FIGS. 8, 9, and 10, wherein outrigger mount is shown without the electrical contacts and all of the like parts of like numbers as for the outrigger 48.

Although a specific embodiment of the herein disclosed invention has been described in detail above, it is readily apparent that those skilled in the art may make various modifications and changes in the track lighting system without departing from the spirit and scope of the invention. It is to be expressly understood that the instant invention is limited only by the appended claims.

What is claimed is:

1. A low voltage track lighting system comprising; a bendable flat track having a flat insulator base, said base having a pair of opposed flat sides, said base having a depth greater than its thickness, a thin flat electrical conductor fixed to each of the flat sides forming conductors on opposite sides of the base, a step down transformer adapted to be connected to a source of electric power, a feed mount adapted to be fixed to a supporting surface to be held thereby, an electric conductive path in said feed mount connected to each conductor and to the step down transformer to connect the conductors to the step down transformer, an adapter supported on the track and having electrical contact with each of the conductors of the track, and a low voltage lamp supported on the adapter and in electric contact with the electrical contacts of the adapter to be energized by an electric current from the step down transformer.

2. A low voltage track lighting system as defined in claim 1, wherein said feed mount has a housing, a slot extending through said housing receiving the track, said slot extending to the end of the housing to open at the housing end, and a cap secured to the housing to one end to close the open end of the slot to hold the track in the housing.

3. A low voltage track lighting system as defined in claim 1, said electric conductive path including a resilient contact in the feed mount, each resilient contact having an elongated contact pad engaged with a respective conductor, said contacts being offset from each other avoiding contact with each other when there is no track between the contacts.

4. A low voltage track lighting system as defined in claim 1, wherein said feed mount includes an outrigger, said outrigger having one end adapted to be secured to the supporting surface to be held thereby, an insulator post mounted in another end of the outrigger opposite the first-mentioned end, said post being adapted to be positioned in an aperture in the track, and said electric conductive path including an exterior contact extending through an interior of the outrigger and the post for electrical contact with one of the electrical conductors and an interior contact extending through the interior of the outrigger for electrical contact with the other of the electrical conductors.

5. A low voltage track lighting system as defined in claim 1, wherein the feed mount includes an elongated outrigger, said outrigger having one end adapted to be secured to a supporting surface to be held thereby, an insulator post mounted in an end of the outrigger opposite to the first-mentioned end, said post being adapted to be positioned in an aperture in the track, said electric conductive path including an exterior contact extending through an interior of the outrigger and the interior of the post, an electrical conductive fastener mounted in the post electrically connected to the exterior contact and to one of the electrical conductors and securing the track to the outrigger, and an interior contact extending through the interior of the outrigger in electrical connection with the other of the electrical conductors.

6. A low voltage track lighting system as defined in claim 1, including a link for making electrical and mechanical butt linkage between an end of said track and an end of another track, said link including a body having opposed slots for receiving an end of each track in each slot, and a pair of electrical contact strips mounted in the body, each contact strip connecting to each of the conductors from said track to each conductor of the other track.

7. A low voltage track lighting system as defined in claim 1, wherein said adapter includes a lamp housing, said lamp housing having a slot extending through the lamp housing and opening into one end of the lamp housing for receiving the track, a cap mounted on the end of the lamp housing having the slot opening to support the lamp housing on the track, a pair of resilient lamp contacts in said lamp housing, and each lamp contact having an elongated pad engageable with the respective conductor of the track, said lamp contacts being electrically connected to the low voltage lamp.

8. A low voltage track lighting system as defined in claim 1, including a lamp holder connected to the adapter, said lamp holder having a shell, a shield mounted in the shell spaced from the shell, said low voltage lamp supported in the shield, whereby heat generated by the lamp is absorbed by the shield and spacing of the shield from the shell allows collected heat to be dissipated.

9. A low voltage track lighting system as defined in claim 1, including a lamp holder connected to the adapter, said lamp holder having a shell, a shield mounted in the shell spaced from the shell, said low voltage lamp supported in the shield by a plurality of spring fingers.

10. A low voltage track lighting system as defined in claim 1, said feed mount being a monopoint having a canopy adapted to be secured to the supporting surface, a split housing fixed to the canopy, said conductive path having a resilient angle contact mounted in the housing, said split housing having an end slot for receiving an end of the track, and the conductors of the track electrically connected to respective angle contacts.

11. A low voltage track lighting system as defined in claim 1, wherein the adapter includes a lamp housing, said lamp housing having a slot extending through the lamp housing, an opening in one end of the lamp housing for receiving the track, a cap mounted on the end of the lamp housing having the slot opening to support the lamp housing on the track, a pair of resilient lamp contacts in said lamp housing, each lamp contact having an elongated pad engageable with a respective conductor, a lamp holder connected to the lamp housing, said lamp holder having a shell, a shield mounted in the shell spaced from the shell, the low voltage lamp supported in the shield, whereby heat generated by the lamp is absorbed by the shield and spacing of the shield from the shell allows the collected heat to be dissipated.

12. A low voltage track lighting system as defined in claim 1, including a lamp holder connected to the adapter, said lamp holder having a shell, an elongated cylindrical shield supported in the shell by a plurality of resilient shield fingers, said low voltage lamp supported in the shield by a plurality of resilient lamp fingers, whereby heat generated by the lamp is absorbed by the shield and spacing of the shield from the shell allows collected heat to be dissipated, said feed mount being a monopoint having a canopy secured to the supporting surface, a split housing fixed to the canopy, said conductive path having a resilient angle contact mounted in the housing, said split housing having an end slot for receiving an end of the track and the conductors of the track in electrical contact with respective angle contacts.

13. A low voltage track lighting system as defined in claim 1, said electric conductive path including a resilient contract in the feed mount, said contact having an elongated contact pad engaged with a respective conductor, said resilient contacts being offset from each other avoiding contact with each other when there is no track between the resilient contacts, said adapter includes a lamp housing, said lamp housing having a slot extending through the lamp housing and opening in one end of the lamp housing for receiving the track, a cap mounted on the end of the lamp housing having the slot opening to support the lamp housing on the track, said electrical contacts of said adapter having a pair of resilient lamp contacts in said lamp housing, and each lamp contact having an elongated pad engaged with a respective conductor of the track, said lamp contacts being electrically connected to the low voltage lamp.

14. A low voltage track lighting system as defined in claim 1, wherein the adapter includes a lamp housing, said lamp housing having a slot extending through the lamp housing, an opening in one end of the lamp housing for receiving the track, a cap mounted on the end of the lamp housing having the slot opening to support the lamp housing on the track, a pair of resilient lamp contacts in said lamp housing, each lamp contact having an elongated pad engaged with a respective conductor, a lamp holder connected to the lamp housing, said lamp holder having a shell, an elongated cylindrical shield supported in the shell by a plurality of spring fingers, and said low voltage lamp spaced from and supported in the shield by a plurality of resilient lamp fingers, whereby heat generated by the lamp is absorbed in part by the shield and spacing of the shield from the shell and the lamp from the shield allows heat to be dissipated from the lamp holder.

15. A low voltage track lighting system as defined in claim 1, wherein said feed mount has an outrigger, said outrigger having one end adapted to be secured to the supporting surface to be held thereby, an insulator post mounted in another end of the outrigger opposite the first-mentioned end, said post being adapted to be positioned in an aperture in the track, said electric conductive path including an exterior contact extending through an interior of the outrigger and the post for electrical contact with one of the electrical conductors and an interior contact extending through the interior of the outrigger for electrical contact with the other of the electrical conductors, a lamp holder connected to the adapter, said lamp holder having a shell, an elongated cylindrical shield mounted in the shell spaced from the shell, said low voltage lamp supported in the shield, whereby heat generated by the lamp is absorbed by the shield and spacing of the shield from the shell allows collected heat to be dissipated.

16. A low voltage track lighting system as defined in claim 1, said electric conductive path including a resilient contact in the feed mount, each contact having an elongated contact pad engaged with a respective conductor, said contacts being offset from each other avoiding contact with each other when there is no track between the contacts, said adapter includes a lamp housing, said lamp housing having a slot extending through the lamp housing and opening in one end of the lamp housing for receiving the track, a cap mounted on the end of the lamp housing having the slot opening to support the lamp housing on the track, a pair of resilient lamp contacts in said lamp housing, each lamp contact having an elongated lamp pad engaged with the respective conductor of the track, said lamp contacts being electrically connected to the low voltage lamp, a lamp holder connected to the adapter, said lamp holder having a shell, an elongated cylindrical shield mounted in the shell spaced from the shell, said low voltage lamp supported in the shield, whereby heat generated by the lamp is absorbed by the shield and spacing of the shield from the shell allows collected heat to be dissipated.

17. A low voltage track lighting system as defined in claim 1, said electric conductive path including a resilient contact in the feed mount, each contact having an elongated contact pad engaged with a respective conductor, said contacts being offset from each other avoiding contact with each other when there is no track between the contacts, said adapter includes a lamp housing, said lamp housing having a slot extending through the lamp housing and opening in one end of the lamp housing for receiving the track, a cap mounted on the end of the lamp housing having the slot opening to support the lamp housing on the track, a pair of resilient lamp contacts in said lamp housing, and each lamp contact having an elongated lamp pad engaged with a respective conductor of the track, said lamp contacts being electrically connected to the low voltage lamp, a lamp holder connected to the lamp housing, said lamp holder having a shell, an elongated cylindrical shield mounted in the shell and being spaced from the shell, said low voltage lamp supported in the shield by a plurality of spring fingers.

18. A low voltage track lighting system as defined in claim 1, wherein said feed mount has an outrigger, said outrigger having one end adapted to be secured to the supporting surface to be held thereby, an insulator post mounted in another end of the outrigger opposite the first-mentioned end, said post being adapted to be positioned in an aperture in the track, said electric conductive path including an exterior contact extending through an interior of the outrigger and the post for electrical contact with one of the electrical conductors and an interior contact extending through the interior of the outrigger for electrical contact with the other of the electrical conductors, said adapter includes a lamp housing, said lamp housing having a slot extending through the lamp housing and opening in one end of the lamp housing for receiving the track, a cap mounted on the end of the lamp housing having the slot opening to support the lamp housing on the track, a pair of resilient lamp contacts in said lamp housing, and each lamp contact having an elongated lamp pad engage, with the respective conductor of the track, and said lamp contacts being electrically connected to the low voltage lamp.

19. A low voltage track lighting system as defined in claim 1, including a link for making electrical and mechanical butt linkage between an end of said track and an end of another track, said link including a body having opposed slots for receiving the end of each track in each slot, a pair of electrical contact strips mounted in the body, each strip connecting one of the conductors from said track to a conductor of the other track, said feed mount being a monopoint having a canopy secured to the supporting surface, a split housing fixed to the canopy, said conductive path having a resilient angle contact mounted in the housing, said split housing having an end slot for receiving an end of the track and the conductors of the track in electrical connection with respective angle contacts, a second feed mount has an elongated outrigger, said outrigger having one end adapted to be secured to a supporting surface to be held thereby, an insulator post mounted in an end of the outrigger opposite to the first-mentioned end, said post being adapted to be positioned in an aperture in the track, second electric conductive path including an exterior contact extending through an interior of the outrigger and the interior of the post, an electrical conductive fastener mounted in the post electrically connected to the exterior contact and to one of the electrical conductors and securing the track to the outrigger, and an interior contact extending through the interior of the outrigger for electrical connection with the other of the electrical conductors.

20. A low voltage track lighting system as defined in claim 1, wherein said feed mount has an outrigger, said outrigger having one end adapted to be secured to the supporting surface to be held thereby, an insulator post mounted in another end of the outrigger opposite the first-mentioned end, said post being adapted to be positioned in an aperture in the track, said electric conductive path including an exterior contact extending through an interior of the outrigger and the post for electrical contact with one of the electrical conductors and an interior contact extending through the interior of the outrigger for electrical contact with the other of the electrical conductors, said adapter includes a lamp housing, said lamp housing having a slot extending through the lamp housing and opening in one end of the lamp housing for receiving the track, a cap mounted on the end of the lamp housing having the slot opening to support the lamp housing on the track, said electrical contacts of said adapter having a pair of resilient lamp contacts in said lamp housing, each lamp contact having an elongated lamp pad engaged with the respective conductor of the track, said lamp contacts being electrically connected to the low voltage lamp, a lamp holder connected to the adapter, said lamp holder having a shell, an elongated cylindrical shield mounted in the shell spaced from the shell, said low voltage lamp supported in the shield, whereby heat generated by the lamp is absorbed by the shield and spacing of the shield from the shell allows collected heat to be dissipated.

21. A low voltage track lighting system as defined in claim 1, wherein said feed mount has an outrigger, said outrigger having one end adapted to be secured to the supporting surface to be held thereby, an insulator post mounted in another end of the outrigger opposite the first-mentioned end, said post being adapted to be positioned in an aperture in the track, said electric conductive path including an exterior contact extending through an interior of the outrigger and the post for electrical contact with one of the electrical conductors and an interior contact extending through the interior of the outrigger for electrical contact with the other of the electrical conductors, said adapter includes a lamp housing, said lamp housing having a slot extending through the lamp housing and opening in one end of the lamp housing for receiving the track, a cap mounted on the end of the lamp housing having the slot opening to support the lamp housing on the track, said electrical contacts of said adapter having a pair of resilient lamp contacts in said lamp housing, each lamp contact having an elongated lamp pad engaged with the respective conductor of the track, said lamp contacts being electrically connected to the low voltage lamp, a lamp holder connected to the lamp housing, said lamp holder having a shell, an elongated cylindrical shield mounted in the shell and being spaced from the shell, and said low voltage lamp supported in the shield by a plurality of spring fingers.

22. A low voltage track lighting system as defined in claim 1, wherein the feed mount has an elongated outrigger, said outrigger having one end adapted to be secured to a supporting surface to be held thereby, an insulator post mounted in an end of the outrigger opposite to the first-mentioned end, said post being adapted to be positioned in an aperture in the track, said electric conductive path including an exterior contact extending through an interior of the outrigger and the interior of the post, an electrical conductive fastener mounted in the post electrically connected to the exterior contact and to one of the electrical conductors and securing the track to the outrigger, an interior contact extending through the interior of the outrigger for electrical connection with the other of the electrical conductors, said adapter includes a lamp housing, said lamp housing having a slot extending through the lamp housing and opening in one end of the lamp housing for receiving the track, a cap mounted on the end of the lamp housing having the slot opening to support the lamp housing on the track, said electrical contacts of said adapter having a pair of resilient lamp contacts in said lamp housing, each lamp contact having an elongated lamp pad engaged with the respective conductor of the track, said lamp contacts being electrically connected to the low voltage lamp, a lamp holder connected to the adapter, said lamp holder having a shell, an elongated cylindrical shield mounted in the shell and being spaced from the shell, said low voltage lamp supported in the shield by a plurality of spring fingers, whereby heat generated by the lamp is absorbed by the shield and spacing of the shield from the shell allows the collected heat to be dissipated.

23. A low voltage track lighting system as defined in claim 1, wherein said feed mount has a housing, a slot extending through said housing receiving the track and extending to the end of the housing to open at the housing end, a cap secured to the housing to one end to close the open end of the slot to hold the track extending through the slot, said electric conductive path including a resilient contact in the feed mount, each contact having an elongated contact pad engaged with a respective conductor, said resilient contacts being offset from each other avoiding contact with each other when there is no track between the resilient contacts, a second feed mount has an elongated outrigger, said outrigger having one end adapted to be secured to a supporting surface to be held thereby, an insulator post mounted in an end of the outrigger opposite to the first-mentioned end, said post being adapted to be positioned in an aperture in the track, a second electric conductive path including an exterior contact extending through an interior of the outrigger and an interior of the post, an electrical conductive fastener mounted in the post electrically connected to the exterior contact and to one of the electrical conductors and securing the track to the outrigger, an interior contact extending through the interior of the outrigger for electrical connection with the other of the electrical conductors, a link making electrical and mechanical butt linkage between an end of said track and an end of another track, said link including a body having opposed slots for receiving an end of each track in each slot, a pair of electrical contact strips mounted in the body, each strip connecting to each of the conductors from said track to each conductor the other track, said adapter includes a lamp housing, said lamp housing having a slot extending through the lamp housing and opening in one end of the lamp housing for receiving the track, a lamp cap mounted on the end of the lamp housing having the slot opening to support the lamp housing on the track, said electrical contacts of said adapter having a pair of resilient lamp contacts in said lamp housing, each lamp contact having an elongated lamp pad engaged with the respective conductor of the track, said lamp contacts being electrically connected to the low voltage lamp, a lamp holder connected to the lamp housing, said lamp holder having a shell, an elongated cylindrical shield supported in the shell by a plurality of resilient shield fingers, said low voltage lamp supported in the shield by a plurality of spring lamp fingers, and a third feed mount being a monopoint having a canopy secured to the supporting surface, a split housing fixed to the canopy, a pair of resilient angle contacts mounted in the split housing, said split housing having an end slot for receiving the other end of the track, and the conductors of the track electrically connected to respective angle contacts.

* * * * *

UNITED STATES PATENT AND TRADEMARK OFFICE

CERTIFICATE OF CORRECTION

PATENT NO. : 6,244,733 B1
DATED : June 12, 2001
INVENTOR(S) : Franklin Fong et al.

It is certified that error appears in the above-identified patent and that said Letters Patent is hereby corrected as shown below:

Title page,
The title page should be deleted to appear as per attached title page.

Drawings,
Substitute the attached drawings, FIGS. 1-26 with the issued patent.

Signed and Sealed this

Fourteenth Day of May, 2002

*Attest:*

*Attesting Officer*

JAMES E. ROGAN
*Director of the United States Patent and Trademark Office*

(12) United States Patent
Fong et al.

(10) Patent No.: US 6,244,733 B1
(45) Date of Patent: Jun. 12, 2001

(54) LOW VOLTAGE TRACK LIGHTING SYSTEM

(75) Inventors: Franklin Fong, Wheeling; John J. O'Rourke, Downers Grove; Scott Roos, Glenview; Peter F. Wachter, Northfield, all of IL (US)

(73) Assignee: Juno Manufacturing, Inc., Des Plaines, IL (US)

( * ) Notice: Subject to any disclaimer, the term of this patent is extended or adjusted under 35 U.S.C. 154(b) by 0 days.

(21) Appl. No.: 09/513,359

(22) Filed: Feb. 25, 2000

(51) Int. Cl.[7] ..... F21V 21/35

(52) U.S. Cl. ..... 362/391; 362/147; 362/404

(58) Field of Search ..... 362/147, 226, 362/238, 239, 249, 250, 391, 373, 404, 294, 269, 407, 427; 439/110, 111, 112, 116, 117, 119

(56) References Cited

U.S. PATENT DOCUMENTS

| | | | | |
|---|---|---|---|---|
| 3,037,110 | * | 5/1962 | Williams | 362/404 |
| 4,861,273 | | 8/1989 | Wenman et al. . | |
| 4,979,081 | | 12/1990 | Leach et al. . | |
| 5,151,037 | | 9/1992 | Range et al. . | |
| 5,151,038 | | 9/1992 | Range et al. . | |
| 5,154,509 | * | 10/1992 | Wulfman et al. | 362/226 |
| 5,340,322 | | 8/1994 | Poulsen . | |
| 5,455,754 | | 10/1995 | Hoffner . | |
| 5,833,358 | | 11/1998 | Patik . | |
| 6,022,129 | * | 2/2000 | Tang | 362/404 |

* cited by examiner

*Primary Examiner*—Y. Quach
(74) *Attorney, Agent, or Firm*—Anthony S. Zummer

(57) ABSTRACT

The present invention is an improved low voltage track lighting system. The system includes a flat track which may be bent. The track has a flat insulator base with opposed flat sides. The depth of the base is greater than its thickness. A thin flat electrical conductor is fixed to each of the flat sides of the base forming conductors on opposite sides of the base. A step down transformer is adapted to be connected to a source of electric power. A feed mount is adapted to be fixed to a supporting surface to be held by the supporting surface. An electric conductive path in the feed mount is connected to each conductor and to the step down transformer, so that each of the conductors is connected to the step down transformer. An adapter is supported on the track and is in electric contact with each of the conductors of the track. A low voltage lamp is supported on the adapter and in electric contact with the adapter to be energized by an electric current from the step down transformer.

23 Claims, 16 Drawing Sheets

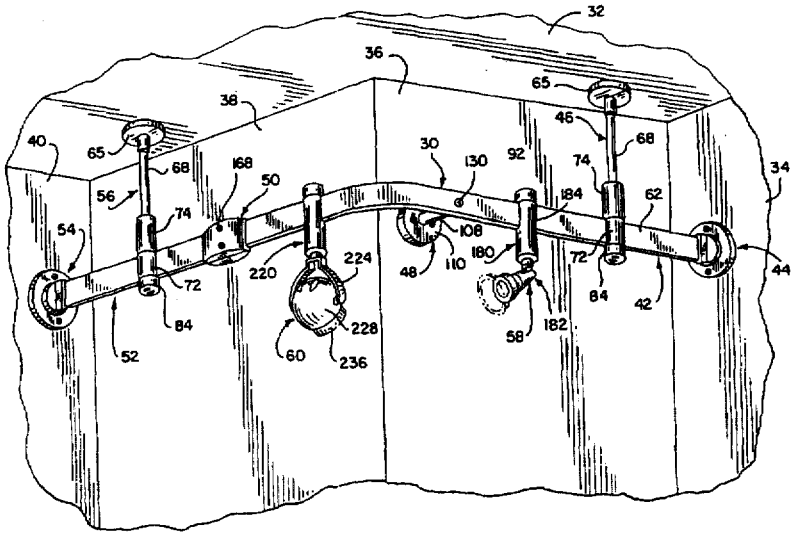

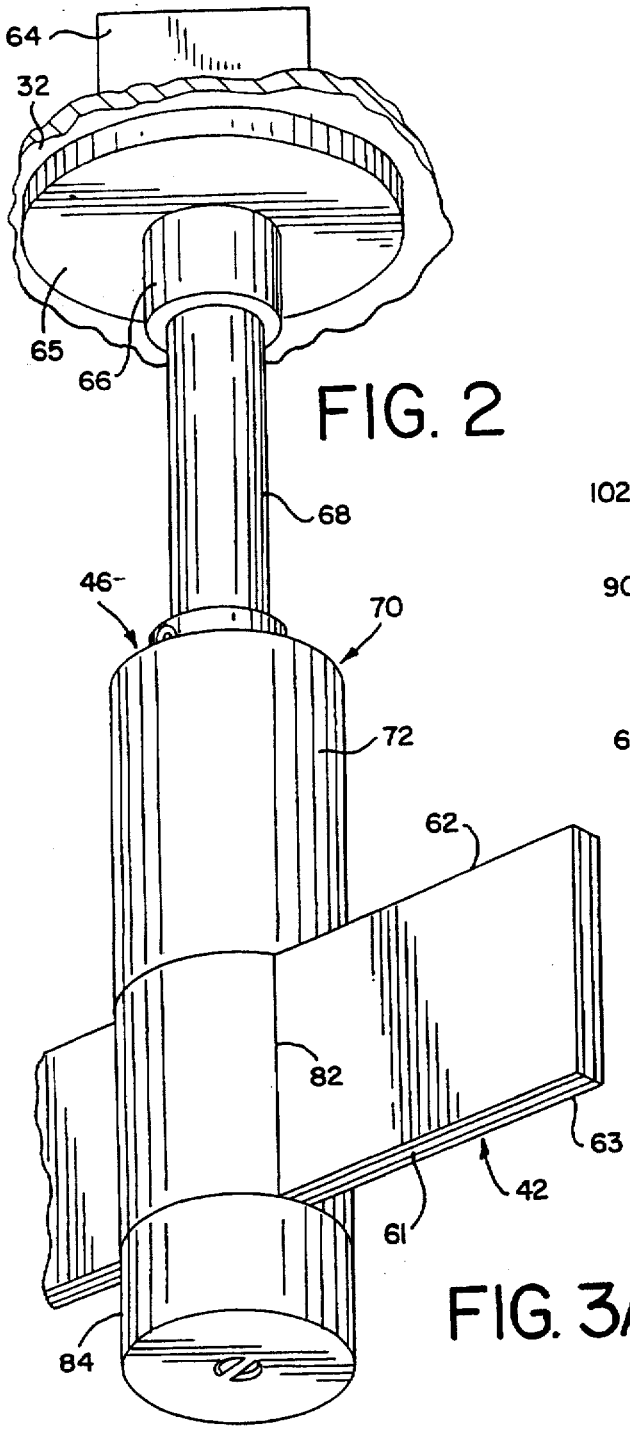
FIG. 2
FIG. 3
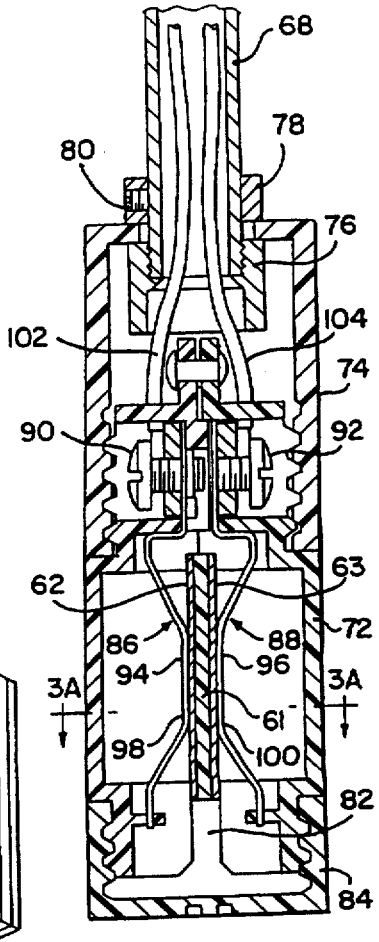
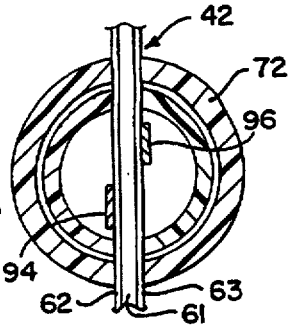
FIG. 3A